US012324493B2

(12) United States Patent
Dickerson

(10) Patent No.: US 12,324,493 B2
(45) Date of Patent: Jun. 10, 2025

(54) PARASOL FAN, SYSTEMS, AND ASSEMBLIES

(71) Applicant: Ryan L. Dickerson, Mooresville, NC (US)

(72) Inventor: Ryan L. Dickerson, Mooresville, NC (US)

(73) Assignee: Alizé Umbrella, LLC, Mooresville, NC (US)

( * ) Notice: Subject to any disclaimer, the term of this patent is extended or adjusted under 35 U.S.C. 154(b) by 237 days.

(21) Appl. No.: 18/139,418

(22) Filed: Apr. 26, 2023

(65) Prior Publication Data

US 2023/0337792 A1 Oct. 26, 2023

Related U.S. Application Data

(60) Provisional application No. 63/363,636, filed on Apr. 26, 2022.

(51) Int. Cl.

| | |
|---|---|
| ***A45B 23/00*** | (2006.01) |
| ***A45B 25/06*** | (2006.01) |
| ***A45B 25/10*** | (2006.01) |
| ***F04D 19/00*** | (2006.01) |
| ***F04D 25/06*** | (2006.01) |

(52) U.S. Cl.

CPC ..... *A45B 23/00* (2013.01); *A45B 25/06* (2013.01); *A45B 25/10* (2013.01); *F04D 19/002* (2013.01); *F04D 25/06* (2013.01); *A45B 2200/1036* (2013.01)

(58) Field of Classification Search

CPC ..... A45B 23/00; A45B 25/06; A45B 25/10; A45B 2200/1036

See application file for complete search history.

(56) References Cited

U.S. PATENT DOCUMENTS 2,270,029 A * 1/1942 Bagnall ..... B60J 1/2005 296/91
2,662,966 A * 12/1953 Bruchhausen ..... A47J 36/2483 219/460.1
3,177,881 A * 4/1965 Covington ..... A45B 3/00 D3/1
3,228,317 A * 1/1966 Westman ..... F24F 7/025 454/370
3,401,874 A * 9/1968 Covington ..... A45B 3/00 416/142

(Continued)

*Primary Examiner* — Noah Chandler Hawk
(74) *Attorney, Agent, or Firm* — Rogowski Law LLC

(57) ABSTRACT

Disclosed herein are a parasol fan assembly and systems for moving air to cool individuals near a parasol. A parasol fan assembly includes a parasol fan structure comprising at least one attachable fan device. The attachable fan device attaches to a portion of the parasol fan structure, such as a strut, and the device includes rotatable fan blades that are driven by an electric motor. The presently disclosed attachable fan device include an electrical actuator mechanism which ensures that when the operation of the device ceases the fan blades become stationary and parallel to the strut and thus do not interfere with folding the parasol fan assembly. In some embodiments, the parasol fan assembly further comprises a safety mechanism comprising a Hall sensor, the mechanism prevents accidental operation of the attachable fan device.

18 Claims, 34 Drawing Sheets

(56) References Cited

U.S. PATENT DOCUMENTS

| | | | | |
|---|---|---|---|---|
| 6,691,721 | B2 * | 2/2004 | Apple | A45B 3/00<br>417/313 |
| 10,138,894 | B1 * | 11/2018 | O'Connor | F04D 25/084 |
| 10,238,191 | B2 * | 3/2019 | Shurie | A45B 25/00 |
| 2004/0149325 | A1 * | 8/2004 | Kuelbs | F24F 5/0035<br>135/20.3 |
| 2012/0152292 | A1 * | 6/2012 | Taylor | A45B 23/00<br>135/16 |

* cited by examiner

PARASOL FAN, SYSTEMS, AND ASSEMBLIES

FIELD

This disclosure relates to compact attachable fan devices for use with parasols and umbrellas, and related systems and assemblies. The devices, systems, and assemblies may be used for fanning individuals underneath a parasol with a device or system installed thereto.

BACKGROUND

Many individuals sit or stand underneath parasols and umbrellas to avoid exposure to undesired weather, such as sunshine and rain. In many instances, these individuals may use a parasol or an umbrella as protection from the sun in hot weather, however, when there is little or no wind or breeze, they may become overheated or uncomfortably hot. In addition, in instances where an individual smokes underneath the parasol or the umbrella, the smoke may be experienced by others nearby. Often restaurants or cafes provide large outdoor fans placed near tables. These fans tend to be noisy, blow too hard or too soft and need to be shared amongst many people. In the evening the staff must secure the fans to prevent them being stolen when the establishment is closed.

Attachment of an existing fan device to a parasol or umbrella may be achieved, however, reliable use of the fan device without interfering with operation of the parasol or umbrella is generally not feasible with existing fan devices and systems. The fan device may become detached from the parasol or umbrella due to unreliable attachment means. In addition, when the existing fan device is switched off and the fan blades cease rotation, the fan blades may frequently extend from the fan device and contact a canopy or other structure of the parasol or umbrella with folding, risking damage to the fan device and the parasol or umbrella.

With increasingly hot temperatures it is a challenge to enjoy the outdoors while at the same time staying cool. The present disclosure provides a much-needed solution, greatly increasing the cooling effect of a parasol shading by adding fanning operated according to a user need. There is a need in the field for fan devices, fan devices attachment methods, and fan devices operating systems for improving air flow underneath and around parasols, umbrellas, and other structures. The present invention addresses this unmet need.

SUMMARY

In general, this disclosure provides attachable fan devices and systems that may be installed to, and used with, any of a variety of structures, in particular, parasols and umbrellas. A parasol or umbrella with an attachable fan device installed thereto may be used by a consumer positioned underneath or near the parasol or umbrella. The attachable fan device fans or cools the consumer and is controllable by a control unit, which may be operable by the consumer or another individual, or source of control, such as a centralized control system. The control panel prevents the user from having to stand to adjust the fan speed as well as keeping the user hands clear of all moving parts. The parasol fan or umbrella fan may be beneficial for use with indoor or outdoor seating or dining, indoor or outdoor events such as weddings, funerals, concerts, and sporting events, restaurants, cafes, resorts, hotels, parks, etc.

In some embodiment, the presently disclosed attachable fan device includes a fan component and a parasol attachment which is configured to attach to a structure, such as a strut of a parasol or a strut of an umbrella. The fan component includes two fan blades that are operable with an electric motor. A shaft of the fan component connects the fan blades to the motor and includes a notched disk affixed thereto. A biased pin is insertable into a notch of the notched disk and is retractable by an actuator, such as an electric solenoid actuator. During operation of the fan and rotation of the fan blades, as occurs as a result of switching the attachable fan device on, the shaft and the notched disk also rotate, and the actuator actively retracts the biased pin to overcome a bias of the biased pin which enters a retracted position to allow the notched disk to rotate freely. When the operation is concluded, as may occur as a result of a user switching the attachable fan device off, the actuator releases the biased pin which succumbs to its bias and enters a protruded position. The protruded biased pin enters the notch of the notched disk to stop the notched disk and, therefore, the shaft and the fan blades. The notches of the notched disk are positioned such that the fan blades are prevented from rotating beyond a parallel configuration with the strut of the parasol or umbrella. In this manner, the attachable fan device may remain attached to the parasol or umbrella before, during, and after use, and the blades of the attachable fan device do not interfere with and are not damaged by a folding of the parasol or umbrella.

In some embodiments, the presently the presently disclosed fan system is comprised of an attachable fan device and a control unit configured to allow control of operation of the attachable fan device. The system or any of its components may be installed (permanently or temporarily/removably) to a structure, such as a parasol or an umbrella. The control unit includes control circuitry, which may be in the form of dedicated electronic hardware circuitry (e.g., electrical wiring), which opens and closes a circuit as a result of operation of the control unit, e.g., operation of a switch by a user. In at least some embodiments, however, the control circuitry may be configured to receive an input, determine an output, and transmit a control signal based on the output, to a receiver of the attachable fan device for wired or wireless control of the attachable fan device. In some embodiments, the control unit includes a charge port configured for charging an electronic device, such as a personal smartphone or tablet device or powering add on features, for example a string of LED lights or an electronic bug catcher. The control unit may be mounted to a pole of the parasol or umbrella to facilitate use by the user.

In some embodiments, the present disclosure provides an attachable fan device, the attachable fan device comprises: a fan component housing, wherein the fan component housing partially encases an electric motor comprising a shaft which rotates when the electric motor is powered by electricity, an electric actuator electrically connected to the electric motor and operably connected to a biased pin, and a notched disk wherein the notched disk comprises at least one notch thereon, the at least one notch is designed to receive the biased pin, and a tubular shaft operably connected to the shaft of the electric motor; a fan component, wherein the fan component comprises two fan blades and a center hub therebetween, the center hub operably attached to the tubular shaft such that the fan blades are substantially parallel to the at least one notch; wherein when the electric motor is powered by electricity, the electric actuator actuates to retract the biased pin from a protruded position in which the biased pin is inserted in the notch to retracted position in which the biased pin is outside the notch, thus allowing the notched disk to rotate and in turn rotate the fan blades; and, wherein when the electric motor is not powered by electricity, the electric actuator releases the biased pin from the retracted position allowing the biased pin to enter the notch, thus preventing the notched disk and fan blades from rotating, and wherein when the fan blades' rotation ceases, the fan blades are positioned substantially parallel to the notch.

In some embodiments, the attachable fan device wherein the notched disk comprises a pair of opposing notches thereon.

In some embodiments, the attachable fan device further comprising two opposing parasol attachments, wherein the parasol attachments are tubular and have a first end and a second end, wherein the first end of each parasol attachment is attached to the fan component housing, and wherein the parasol attachments are substantially parallel to the biased pin.

In some embodiments, the attachable fan device wherein power source for the attachable fan device is selected from a group comprising electricity via electrical wiring, battery, or a plurality of batteries, or a battery connected to a solar panel.

A parasol fan assembly, comprising: a parasol comprising a plurality of ribs, a canopy, a plurality of struts, a pole, and a lower hub engaged to the pole, and wherein each rib of the plurality of ribs comprises a first end and a second end, wherein the second end is coupled to the canopy, and the first end is attached to the pole; wherein each strut of the plurality of struts connects between a rib of the plurality of ribs and the lower hub; wherein at least one strut of the plurality of struts comprises the attachable fan device according to claim 4; and, wherein the said at least one strut comprising the attachable fan device comprise two opposing strut portions, a first strut portion attached to the rib, and a second strut portion attached to the lower hub, the two opposing strut portions attached to the attachable fan device therebetween.

In some embodiments of the parasol fan assembly of claim 5 the pole is a center pole and further comprises an upper hub, the plurality of ribs are pivotally attached to the upper hub, and the end of the center pole opposite to the upper hub is reversibly attached to a base; wherein the attachment of each strut of the plurality of struts to the lower hub is a pivotal attachment; wherein the attachment of each strut of the plurality of struts to a rib of the plurality of ribs is a pivotal attachment; wherein the lower hub is slidable along the center pole, and wherein when the lower hub slides up the pole each strut, and rib pivotally attached to it, rotates outward with respect to the center pole, thus raising the canopy and positioning the parasol fan in an open configuration; and, wherein when the lower hub slides down the center pole each strut, and rib pivotally attached to it, rotates inward with respect to the center pole, thus lowering the canopy and positioning the parasol fan in a closed configuration;

In some embodiments of the parasol fan assembly, the lower hub can be reversibly secured to the center pole in a plurality of pre-determined open configurations.

In some embodiments of the parasol fan assembly, the center pole, the ribs pivotally attached to the struts which comprise the attachable fan device, and the struts which comprise the attachable fan device are tubes.

In some embodiments of the parasol fan assembly, the power source for the attachable fan device is electricity delivered via electrical wiring.

In some embodiments of the parasol fan assembly, the parasol fan comprises a control unit operably connected to the attachable fan device, wherein the control unit comprises: control circuitry operably connected to an at least one switch, the at least one switch is controllable by a user; wherein an operation of a switch of the at least one switch corresponds to the operation of an electric motor of one of the at least one attachable fan device.

In some embodiments of the parasol fan assembly, the electrical wiring runs upward inside the center pole and is electrically connected to the control unit, electrically powering the control unit, wherein from the control unit the electrical wiring runs upward inside the center pole toward the upper hub, from inside the upper hub the electrical wiring runs inside the at least one rib which is pivotally attached to the at least one strut comprising the attachable fan device, from the said at least one rib the wire runs inside the said at least one strut and on to electrically connect to the motor of the attachable fan device, and thus coupling the control unit to the operation of the electrical motor of the attachable fan device; and, wherein the electrical wiring entering the pole comprises an end positioned outside the pole, said end electrically connectable to a source of alternating current.

In some embodiments of the at parasol fan assembly, the upper hub comprises an upper PCB (Printed Circuit Board); wherein the electrical wiring from the control unit is electrically connected to the upper PCB; wherein electrical wiring which runs inside the at least one rib pivotally attached to least one strut comprising the attachable fan device is electrically connected to the upper PCB; and, wherein electrical wiring within the upper PCB electrically connects each of the said electrical wiring from the at least one rib to an electrical power provided by the electrical wiring from the control unit.

In some embodiments of the parasol fan assembly, the control unit comprises a switch for each of the at least one attachable fan device; wherein the electrical wiring from the control unit comprises an electrical wire operably connected to each switch; wherein electrical wiring from each rib of the plurality of ribs which is pivotally attached to the at least one strut comprising the attachable fan device is electrically and operably connected to a specific switch on the control unit, and, thus, allowing a user to separately control the operation of each one of the at least one attachable fan devices.

In some embodiments of the parasol fan assembly, the parasol fan further comprises a Hall sensor, the Hall sensor positioned inside the center pole; wherein the position of the Hall sensor overlaps with the position of the lower hub when the parasol fan is configured in one of the open configurations of the plurality of pre-determined open configurations; wherein the lower hub comprises a magnet; wherein electrical wiring electrically connects the Hall sensor to the upper PCB; wherein electrical wiring inside the upper PCB electrically connects the Hall sensor wiring to the electrical wiring from the control unit, thus operably connecting the Hall sensor to the operation of the control unit.

In some embodiments of the parasol fan assembly, when the parasol fan is in one of the open configurations of the plurality of pre-determined open configurations, and the at least one switch is switched on, the proximity of the magnet to the Hall sensor allows the operation of the at least one attachable fan device; and, wherein when the lower hub is moved from an open configuration of the plurality of pre-determined open configurations downward along the center pole, the distance between the magnet and the Hall sensor increases and the Hall sensor switches off the electrical circuitry of the upper PCB and control unit; and, thus, the at least one attachable device can be operated, or the operation of the at least one attachable device can continue, only when the parasol fan is an open configuration.

In some embodiments of the parasol fan assembly, the parasol fan comprises eight ribs, four struts which comprise an attachable fan device each, and four struts which do not comprise an attachable fan device; wherein a first four ribs of the eight ribs each pivotally attach to a strut which comprise an attachable fan device; wherein a second four ribs of the eight ribs each pivotally attach to a strut which does not comprise an attachable fan device; and, wherein the first four ribs and the second four ribs are arranged in an alternate pattern such that a rib pivotally attached to a strut comprising an attachable fan device is positioned in between two ribs pivotally attached to struts which do not comprise an attachable fan device.

In some embodiments of the parasol fan assembly, the control unit further comprises: a charge port configured to charge an electronic device of the user.

In some embodiments of the attachable fan device, the attachable fan device further comprises two parasol attachment inserts, the parasol attachment inserts substantially tubular and comprising a first end and a second end; wherein a first end of each parasol attachment insert is attached to the second end of each parasol attachment.

In some embodiments of the parasol fan assembly, the attachment of the said strut portions to the attachable fan device is via the second ends of the parasol attachment inserts.

Certain objects, features, and advantages of the present invention will become apparent from the following detailed description taken in conjunction with the accompanying drawings.

BRIEF DESCRIPTION OF THE DRAWINGS

Although the characteristic features of the invention will be particularly pointed out in the claims, exemplary implementations of the invention and manners in which they may be made and used may be better understood after a review of the following description, taken in connection with the accompanying drawings, wherein like numeral annotations are provided throughout.

DETAILED DESCRIPTION

Figure 1:
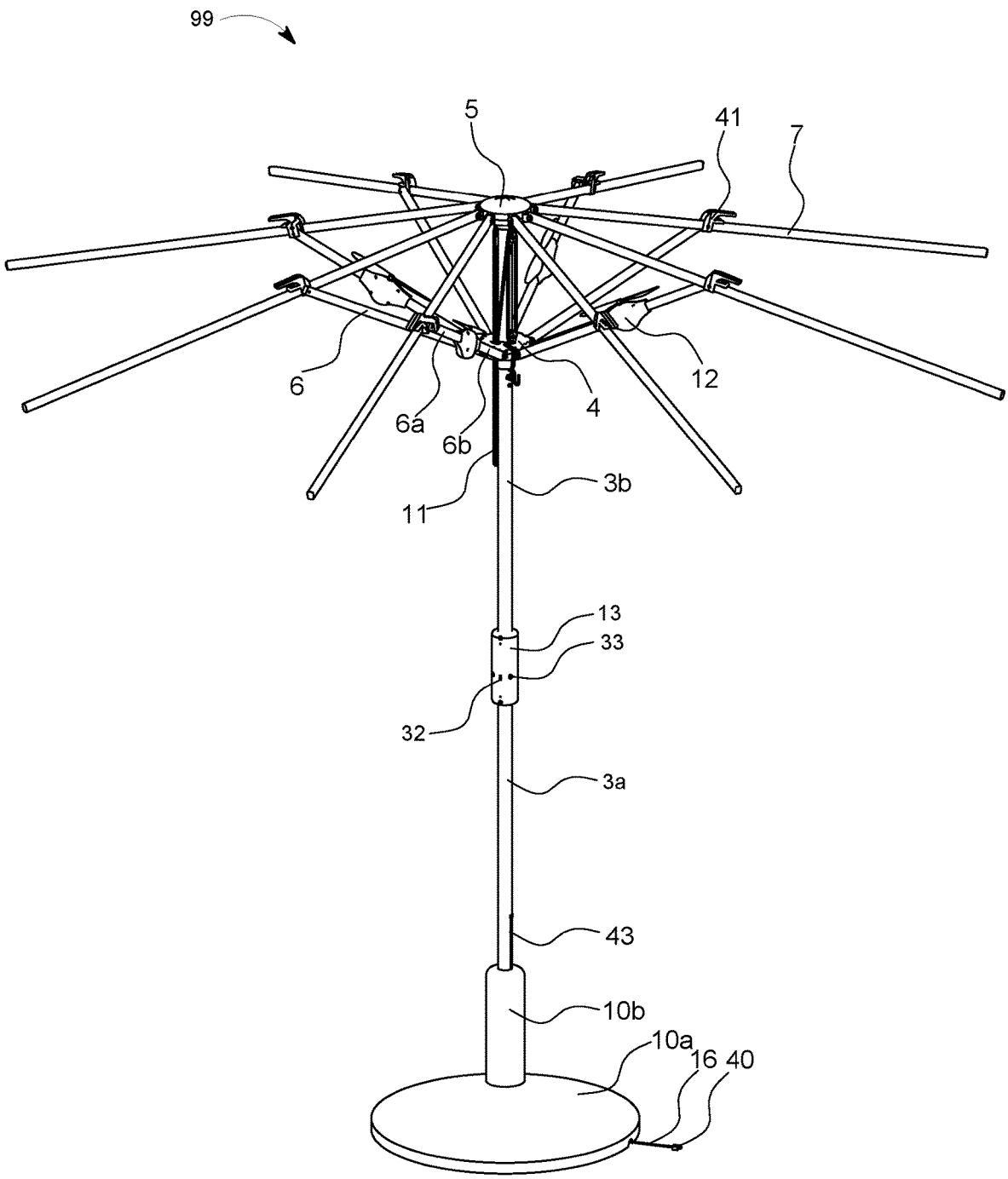
FIG. 1 shows a perspective view illustration of a parasol fan structure, the structure depicted in an open configuration.

Reference is made herein to the attached drawings. Like reference numerals may be used in the drawings to indicate like or similar elements of the description. The figures are intended for representative purposes, are not drawn to scale, and should not be considered limiting.

Unless otherwise defined herein, terms and phrases used in connection with the present disclosure shall have the meanings that are commonly understood by those of ordinary skill in the art.

Where a reference is made to a singular noun, whether with or without use of an indefinite or definite article (e.g., "a", "an", or "the"), this includes a plural of that noun unless something else is specifically stated. Furthermore, the terms first, second, third, and the like in the description and in the claims, are used for distinguishing between elements and not necessarily for describing a sequential or chronological order. It is to be understood that the terms so used are interchangeable under appropriate circumstances and that the implementations of the disclosure described herein are capable of operation in other sequences than described or illustrated herein.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions. By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide. For example, when using the term "substantially" herein it may be a value of at least 50%, at least 60%, at least 70%, at least 80%, at least 90%, or at least 99%, or any amount or range therebetween.

As used herein, terms that may indicate an ability of an element to have a property or characteristic as part of a state of the element include states of the element in which it has the property or characteristic (e.g., is attachable and is attached) as well as states of the element in which it does not have the property or characteristic (e.g., is attachable but is not attached), unless something else is specifically stated. If an element is described as having a property or characteristic (e.g., is attached), this includes elements that may conditionally have the property or characteristic (e.g., may be conditionally attached) as well as elements that may unconditionally have the property or characteristic (e.g., may be unconditionally attached), unless something else is specifically stated.

Referring now to FIG. 1, there is shown an illustration of an embodiment of a parasol fan structure 99 comprised of a center pole comprising pole portions 3*a*, 3*b* and a plurality of ribs 7, each rib 7 is attached to a strut 6, 6*a*. In the example disclosed, the parasol fan structure 99 further comprises a base 10*a* with a base tube 10*b*, a lower hub 4, an upper hub 5, a plurality of the presently disclosed attachable fan devices 12, a control unit 13, and electrical wiring 16 comprising an electrical connector 40. In any of the embodiments disclosed herein, an electrical connector may be any type of electrical plug, a plug, any type of electrical socket, a socket, or a plug and a socket (for example, a contact part on Printed Circuit Boards (PCBs). In the shown embodiment, the parasol fan structure 99 is a structure for a center pole parasol that includes a canopy 2*a*, 2*b* (exemplified in FIG. 17), vent(s) 8, and a rope 11. Rope 11 is part of an adjust system which is further discussed below and which is designed for opening and closing the parasol fan structure/assembly 99, 100 (assembly 100 is exemplified in FIG. 17), raising, and lowering the canopy 2*a*, 2*b*, and securing the parasol fan structure/assembly 99, 100 in an open or closed configuration.

In some embodiments, at least one strut 6*a*, 6*b* of the parasol fan structure/assembly 99, 100 comprises the presently disclosed attachable fan device 12. Struts which comprise the attachable fan device 12 comprise two opposing strut portions 6*a*, 6*b*, a first strut portion 6*a* is attached to the rib 7, and a second strut portion 6*b* is attached to the lower hub 4, and the two opposing strut portions 6*a*, 6*b* are attached to the attachable fan device 12 therebetween. In the embodiment wherein the parasol fan is a center pole type parasol fan (as shown), the attachment of the struts/strut portions 6, 6*a* to the ribs 7 is a pivotal attachment achieved via attachment of each rib 7, and strut/strut portions 6, 6*a* coupled to it, to joint 41. In some embodiments (shown), the attachment of the second strut portion 6*b* to the lower hub 4 is a pivotal attachment. Additionally, in the embodiment shown each rib 7 of the plurality of ribs 7 comprises a first end and a second end. The second end is coupled to the canopy 2*a*, 2*b* (depicted in FIG. 16), and the first end is pivotally attached to the upper hub 5.

Figure 17:
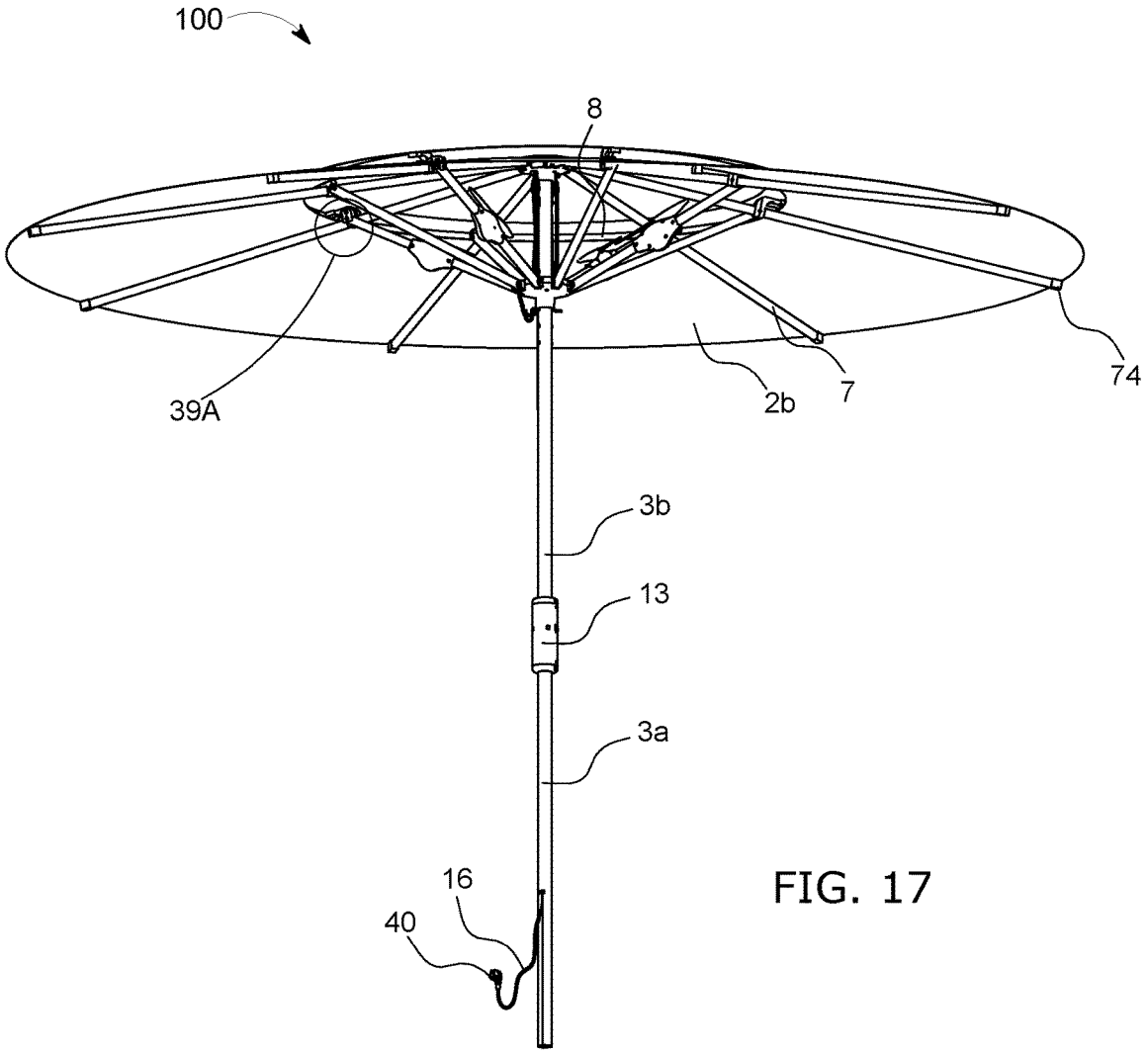
FIG. 17 shows a bottom perspective view illustrating the presently disclosed parasol fan assembly in an open configuration.

The attachable fan device 12 is shown attached to a plurality of strut portions 6*a*, 6*b* of the parasol structure 99, for example, to four pairs of strut portions 6*a*, 6*b*. In some embodiments, the attachable fan device 12 is oriented such that air is blown by the blades 17 of the attachable fan device 12 toward an area underneath or near the canopy 2*a*, 2*b* (as depicted in FIG. 17), e.g., toward a user sitting underneath the canopy 2*a*, 2*b*. In this manner, while the canopy 2*a*, 2*b* is in an open configuration and the attachable fan device 12 operates, air is blown such that an individual sitting underneath the canopy 2*a*, 2*b*, or otherwise near the fan device 12, is fanned by the blown air and is better able to stay cool to limit perspiration or to prevent overheating. As another example of use of the attachable fan device 12, a smoker might sit in a chair underneath the canopy 2*a*, 2*b*, such that the attachable fan device 12 blows air to displace smoke away from other people who may be near the smoker and who may not desire to breathe or be exposed to smoke.

As is further discussed herein, the fan blades 17 of the attachable fan device 12 are configured to be positioned parallel to the strut portions 6*a*, 6*b* when the fan blades are not rotating, or stopped from rotating. Therefore, the attachable fan device 12 may be kept attached to the strut portions 6*a*, 6*b* of the parasol, when the parasol fan structure/assembly 99, 100 is in an open configuration (as shown) or in a closed configuration (i.e., folded into a compact configuration for storage or transport of the parasol fan structure/assembly, e.g., when not in use).

In some embodiments, pole portion 3*a* is attached to the base 10*a*, 10*b*, the attachment may be a reversible attachment. In some embodiments, the parasol fan structure 99 comprises a control unit 13, the control unit comprises at least one switch 33. In the embodiment exemplified in FIG. 1, switch 33 is operably connected to the function of the at least one attachable fan device 12. In some embodiments, the control unit 13 comprises a plurality of switches 33, each switch 33 is operably connected to the function of one attachable fan device 12 (e.g., the attachable fan device 12 positioned substantially above the switch 33 being operated). In some other embodiments, one switch 33 is operably connected to the function of more than one attachable fan devices 12.

In some embodiments, the control unit 13 also includes a charge port 32 to allow a user to charge a personal electronic device, such as a cell phone, tablet, etc. In some embodiments, the control unit 13 is electrically powered via electrical wiring 16. In the example shown, the electrical wiring 16 providing electricity to the control unit 13, runs from under the base 10*a* through an opening 42 (depicted in FIG. 4*b*) in the circumference of the base 10*a*, through the base tube 10*b* and toward the control unit 13 through the center pole 3*a*. In some embodiments, the base 10*a* is hollow and in some other embodiments, base 10*a* comprises a groove (not shown) designed for fitting an electrical wire 16. The end of electrical wire 16 which is outside the base 10*a* and the parasol fan structure 99 comprises an electrical connector 40. Electrical connector 40 is designed to be operably connected into any electrical socket/plug. In some embodiments, electrical connector 40 is operably connected to a power brick. In some embodiments, pole portion 3*a* further comprises opening 43 positioned proximal to its end which is attachable to the base 10*a*, 10*b*. Opening 43 is further discussed herein. While a center pole parasol is shown, other types of parasols, parasol configurations, shading structures are contemplated and may be used without departing from the scope of this invention and disclosure.

Figure 2:
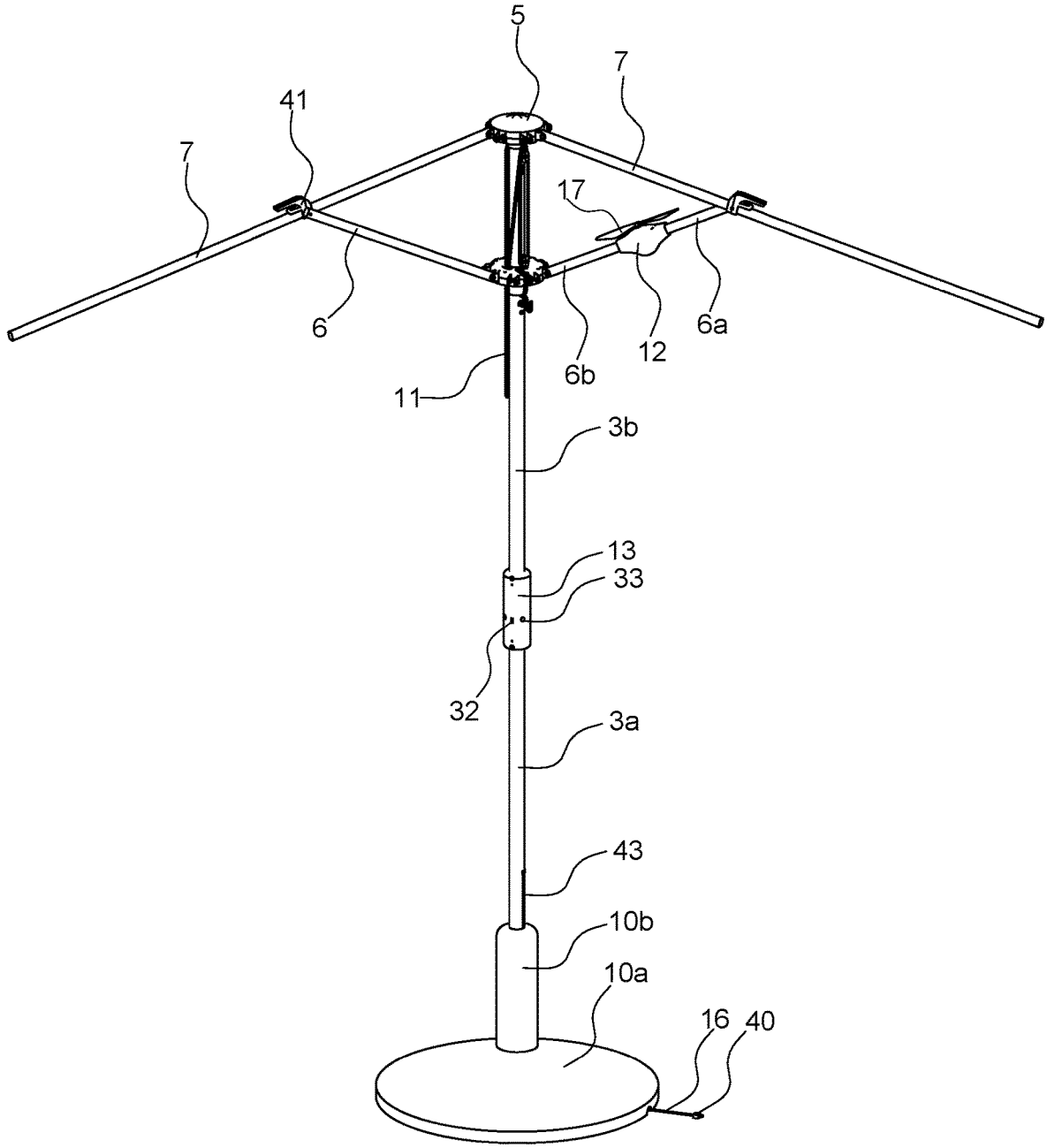
FIG. 2 shows a perspective view illustrating a portion of the structure of the parasol fan illustrated in FIG. 1, depicting a rib attached to a strut which comprises the presently disclosed attachable fan devise and rib attached to a strut which does not comprise the presently disclosed attachable fan devise.

Referring now to FIG. 2, there is shown perspective view of a portion of the parasol fan structure 99 of FIG. 2. It is expressly contemplated herein that the attachable fan device 12 may be attached to any part of the parasol fan structure/assembly 99, 100, or indeed to any part of an applicable structure. However, in the shown configurations, the attachable fan device 12 is attached to strut portions 6*a*, 6*b* of the parasol fan structure/assembly 99. 100. The attachable fan device 12 is shown in an off state such that the fan blades 17 are parallel to the strut portions 6*a*, 6*b* of the parasol fan structure. When the attachable fan device 12 is in an off state (does not operate) the parasol fan structure/assembly 99, 100 may be folded (also referred to herein as closed) and unfolded (e.g., unclosed or opened), canopy 2*a*, 2*b* lowered, and raised without damaging the fan blades 17 and without the fan blades 17 damaging the parasol structure/assembly 99, 100 or parasol canopy 2*a*, 2*b*.

FIG. 2 depicts one assembly of a rib 7 which is pivotally attached to struct 6, and one assembly of a rib 7 which pivotally attached to struct portion 6*a* and in turn to the attachable fan device 12 and strut portion 6*b*. Both ribs 7 are pivotally attached to the center pole 3 via the upper hub 5. Struts/strut portions 6, 6*b* are pivotally attached the lower hub 4 and are slidingly attached to the center pole comprising pole portions 3*a*, 3*b* via the lower hub 4. The parasol fan structure/assembly 99, 100 may be assembled and provided as a unit or, alternatively, may be assembled from a parasol or umbrella and a fan system of the disclosure as an after-market addition or modification. In some embodiments, parts of the parasol fan structure/assembly 99, 100 are tubes, or partially tubular. For example, the parts which are tubes, or partially tubes, can be any or some of the following: base tube 10*b*, pole portions 3*a*, 3*b*, control unit 13, struts/strut portions 6, 6*a*, 6*b*, and/or ribs 7. The tubes of the present disclosure may be any type of tube traditionally used in the art and of any appropriate size, length, or shape.

In some embodiments, electrical wiring 16 delivers power from a source of alternating current (AC) to the control unit 13 or directly to the attachable fan device/s 12. There the alternating current is converted to direct current (DC) for driving an electric motor 20 of the fan device 12. For the center pole type parasol or umbrella, the electrical wiring 16 may run along or inside the pole portions 3*a*, 3*b* and upward toward the upper hub 5, then along, or inside, the rib 7 toward the strut 6*a* (running along or inside strut 6*a*) and on to electrically connect to the attachable fan device 12. For the cantilever type parasol, the electrical wiring 16 may run along or inside the pole and toward an upper joint of the cantilever type parasol, then downward toward the canopy and then along or inside the rib 7 and along or inside the strut 6*a* and on to electrically connect to the attachable fan device 12. In some embodiments (depicted and described herein), electrical wiring running upwards along or inside the pole portion 3*a* or a central pole electrically connects to the control unit 13 and electrical wiring 16 going out of the control unit 13 runs upward along or inside the pole, or pole portion 3*b*, and on to the rib 7 and strut portion 6*a*, as described above, to electrically connect to attachable fan device 12. While in the shown embodiments wired power delivery and wired control of power delivery to the attachable fan device 12 from the control unit 13 are implemented, alternate configurations and implementations are envisioned as described elsewhere herein.

Figure 3:
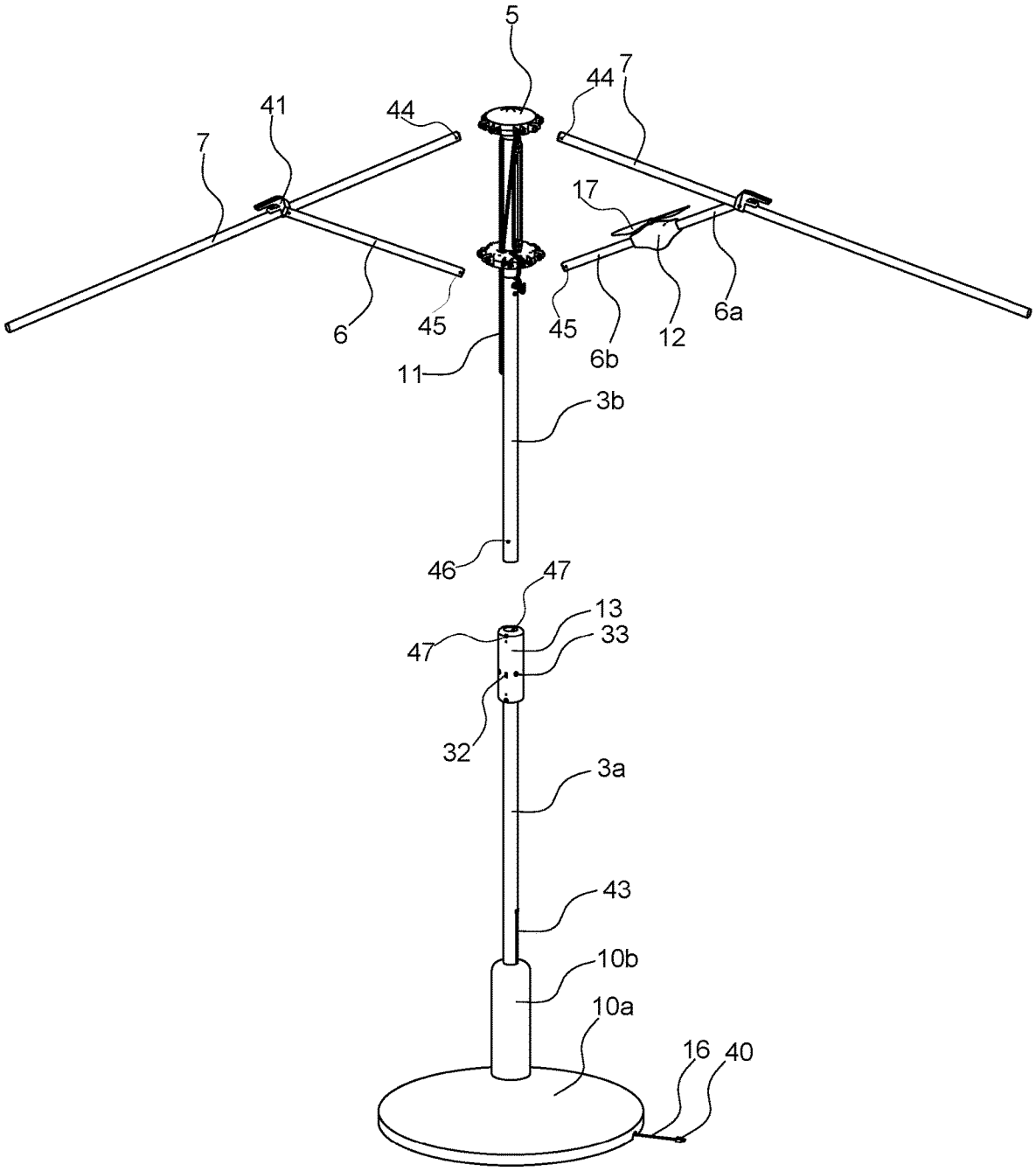
FIG. 3 shows a partly exploded view illustration of the structure depicted in FIG. 2.

FIG. 3 depicts a partly exploded view of the portion of the parasol fan structure illustrated in FIG. 2. In some embodiments, the pole, such as a center pole, comprises two opposing pole portions, 3*a*, 3*b*. A first pole portion 3*a* is attached on a first end to the base 10*a*, 10*b*, and on a second end to the control unit 13. A second pole portion 3*b* is attached on a first end to the control unit 13, and on a second end to the upper hub 5 or upper joint. In some embodiments, control unit 13 comprises at least one opening 47 proximal to each end. In some other embodiments, control unit 13 comprises a pair of opposing opening 47 proximal to each of its ends. By opposing openings, it is meant that a securing means as defined herein can be inserted into one of the openings and then be inserted into the other one, so that it is inserted simultaneously in both. In the example shown, pole portion 3*b* comprises opening 46 proximal to its first end. In other embodiments, pole portion 3*b* comprises two opposing openings 46 proximal to its first end. In some embodiments, the attachment of the control unit 13 to pole portions 3*a* and 3*b* is accomplished by aligning openings 46 and 47 so that they overlap and securing them together via a securing means going through them. The securing means may be, without limitation, a nail, a screw, a rivet, a tack, a pin, a bolt, a dowel (such as a metal dowel), or combinations thereof. In the embodiments when the parasol fan structure/assembly 99, 100 comprises a plurality of switches 33 and a plurality of attachable fan devices 12, and each switch 33 is operably connected to one attachable fan device 12, the attachment of the control unit 13 to pole portion 3*b* is such that the switch 33 operating a certain attachable fan device 12 is positioned substantially beneath it. This way, if one user sitting underneath a parasol fan assembly 100 which comprises a plurality of attachable fan devices 12 wishes to operate just the one attachable fan device 12 most directly above her/him, she/he can do so by switching on the switch 33 closest to her/him. Additionally, according to some embodiments, the pivotal attachment of struts 6 and 6*b* to the lower hub 4 is accomplished using opposing openings 45 as is further discussed and depicted herein. In some embodiments, the pivotal attachment of ribs 7 to the upper hub 5 is accomplished using opposing openings 44 as is further discussed and depicted herein.

Figure 4A:
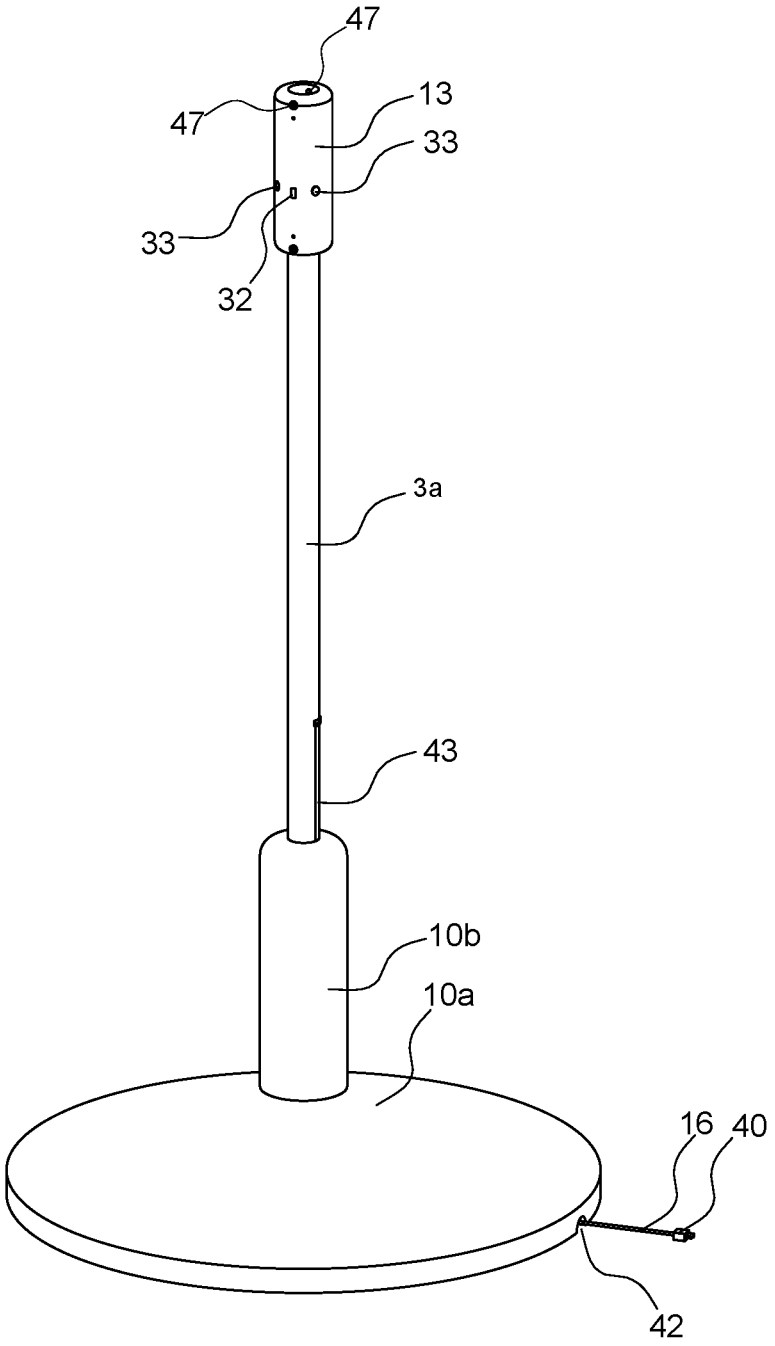
FIG. 4A shows a perspective view illustrating a portion of the structure of the parasol fan illustrated in FIG. 2, depicting a parasol base and a center pole attached to a control unit.
Figure 4B:
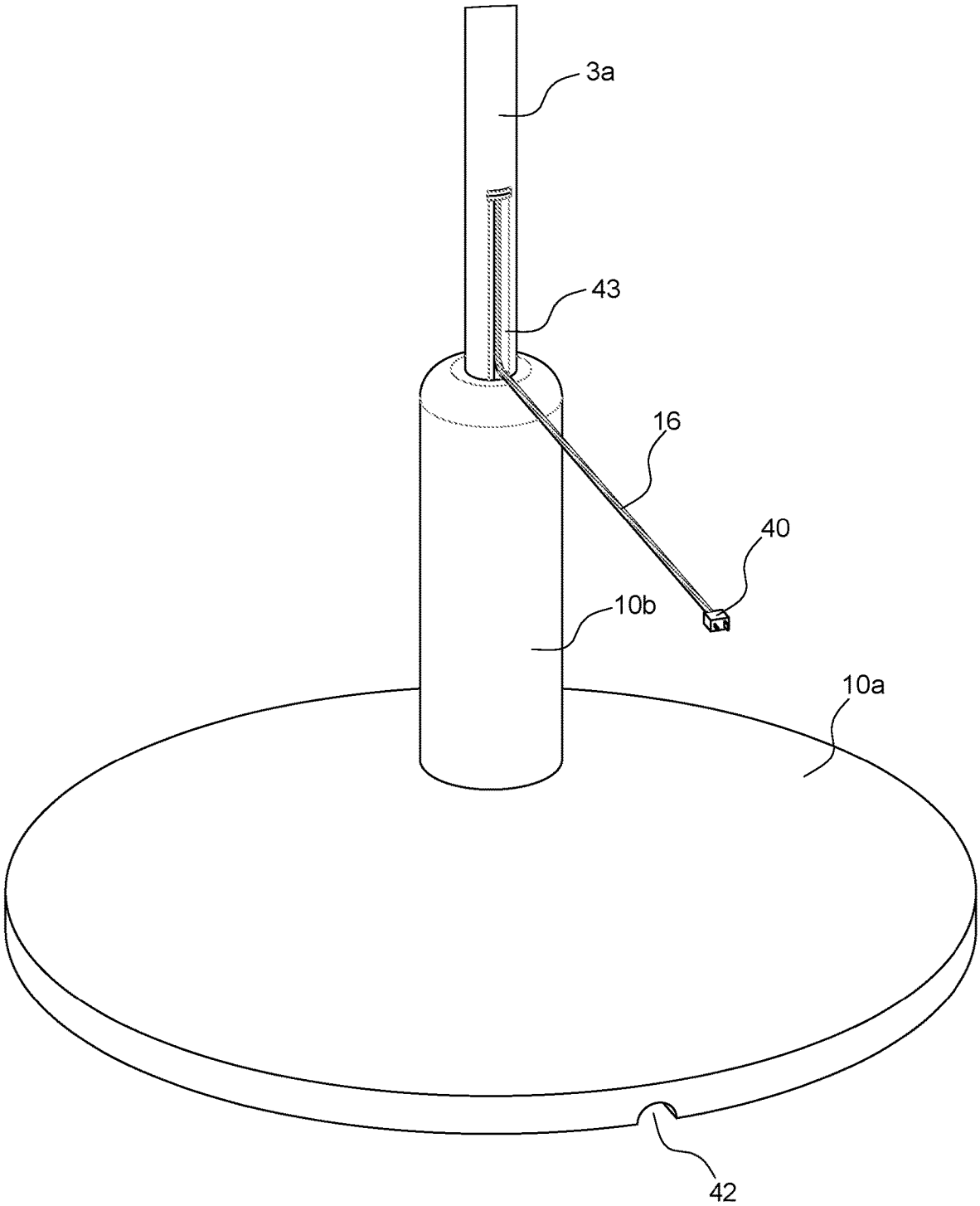
FIG. 4B shows a perspective view illustrating a portion of the structure of the parasol fan illustrated in FIG. 4A, depicting the base and part of the center pole.

Referring now to FIG. 4A, a portion of the parasol fan 99 is illustrated depicting the control unit 13 attached to pole portion 3*a* which is attached to base tube 10*b* and base 10*a*. Opening 42 in base 10*a* allows for the passage of electrical wiring 16. Alternatively, electrical wiring 16 does not pass through the base 10*a*, 10*b*, but is inserted into/exits pole portion 3*a* directly via opening 43.

Figure 5:
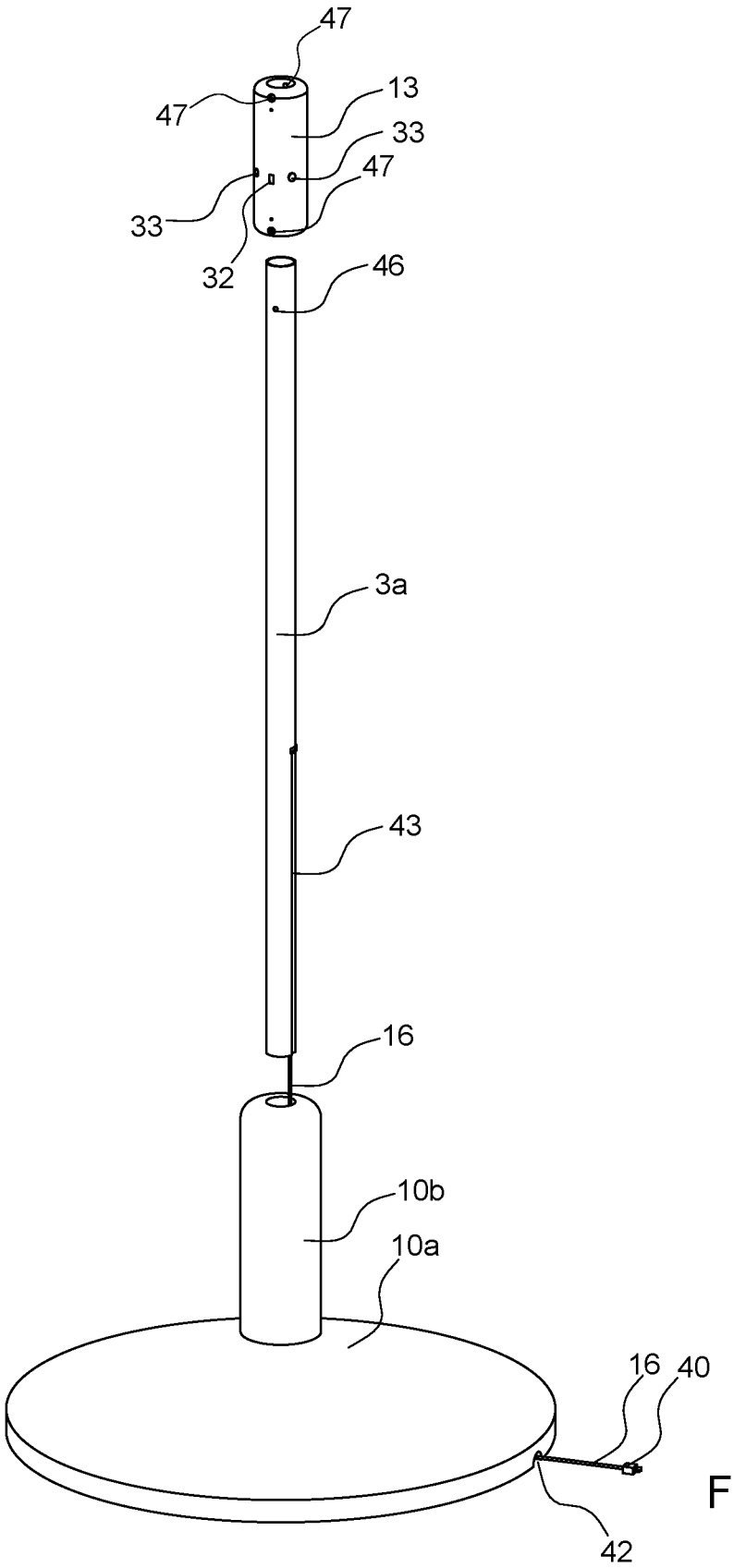
FIG. 5 shows a partly exploded view illustration of the structure depicted in FIG. 4A.

FIG. 5 depicts a partly exploded illustration of the control unit 13, pole portion 3*a*, and base 10*a*, 10*b*. Electrical wiring 16 passage via opening 42, and underneath the base 10*a* and inside base tube 10*b* (not shown), and out of base tube 10*b* to go inside pole portion 3*a*. Opposing openings 47 positioned proximal to the bottom end of control unit 13 are designed to align and overlap with opposing openings 46 positioned proximal to the second end of pole 3*a*. Control unit 13 is attached to pole portion 3*a* by the use of a securing means inserted through aligned and overlapping opposing openings 46 and 47.

While a securing means and designated openings for the use of a securing means are depicted herein, other methods for the attachment of a center pole, or pole portions 3*a* and 3*b*, to the control unit 13 are envisioned herein. For example, spring operated raised tabs designed to fit and lock into matching openings may be used (not shown). Alternatively, sleeves may be configured to engage the body of the control unit 13 along with customized inserts. For example, the inserts may be sized and configured to securely contact a particular corresponding structure, such as a pole portions 3*a*, 3*b* of a particular parasol or umbrella, and in this manner, there may be provided different inserts that are particularly configured for attachment to different structures and other components, such as the mentioned-above sleeves and the control unit 13, may be standardized or manufactured to certain specifications (not shown).

Figure 6:
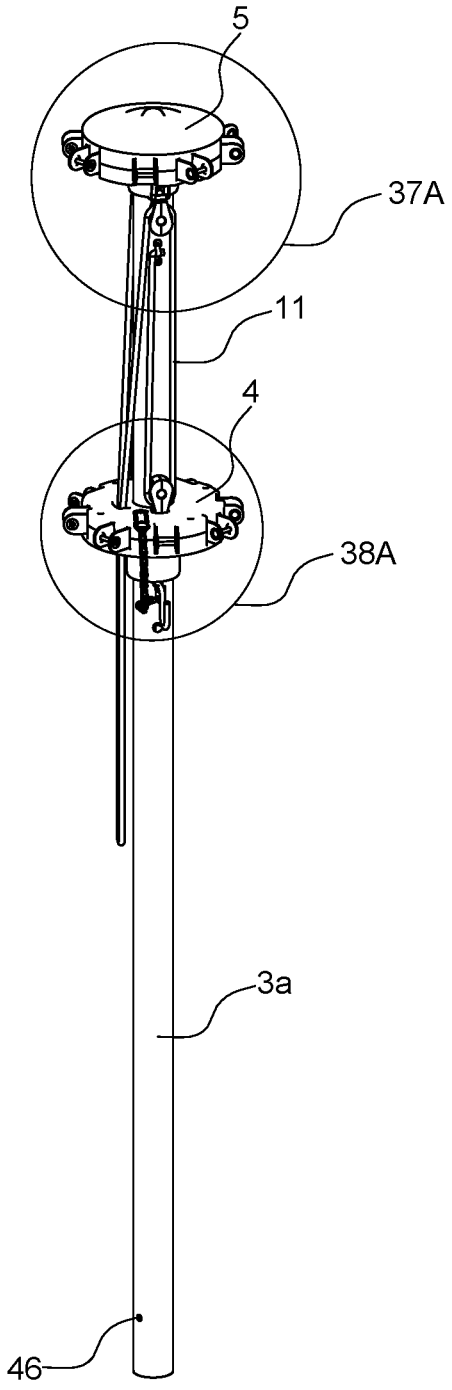
FIG. 6 shows a perspective view illustrating a portion of the structure of the parasol fan illustrated in FIG. 1, depicting a lower hub, an upper hub, and a pulley system.

Pole portion 3*b* is illustrated in FIG. 6, attached to the upper hub 5 and slidingly attached to the lower hub 4. An example of an adjust system designed for opening and closing the parasol fan structure/assembly 99, 100 (assembly 100 is exemplified in FIG. 17), raising, and lowering the canopy 2*a*, 2*b*, and securing the parasol fan structure/assembly 99, 100 in an open or closed configuration is depicted. The adjust system comprises rope 11 and pulleys 14. In some embodiments, the upper hub 5 and the lower hub 4 each comprise one pulley 14, the pulleys 14 are vertically aligned and facing each other and designed for use together, along with rope 11, to adjust the distance of the lower hub 4 relative to the upper hub 5. In some other embodiments, the upper hub 5 and the lower hub 4 each comprise two pulleys 14. Each pulley of the two pulleys 14 on each hub 4, 5 are opposing each other horizontally on the internal circumference (the circumference which is around, and proximal to, pole portion 3*b*) of the hub 4, 5. According to this embodiment, each of the two pulleys 14 of the upper hub are designed for use with a pulley 14 of the lower hub 4 which is vertically aligned to it and faces it, and along with rope 11, facilitate adjustment of the distance of the lower hub 4 relative to the upper hub 5. The lower hub further comprises pin 15 which can be inserted to opening 36 (depicted in FIG. 10) in pole portion 3*b* and secure the lower hub 4 in a desired position. Portion 37A of the parasol fan structure 99 is further depicted in FIG. 7 while portion 38A is further depicted in FIG. 10.

While an adjust system comprising a rope 11 and pulleys 14 is exemplified for the purpose of opening, closing, raising, and lowering the canopy 2*a*, 2*b* of the parasol fan assembly 100, any type adjustment system traditionally used in the art to position a parasol/umbrella structure in an open or closed configuration applies to the presently disclosed parasol fan structure/assembly 99, 100. For example, the adjust system may comprise, without limitation, levers, pulleys, ropes, tabs (e.g., tabs fitting into assigned openings), springs, frictional fits, pins (e.g., pins fitting into assigned openings), nested telescoping sections, and combinations thereof.

Figure 7:
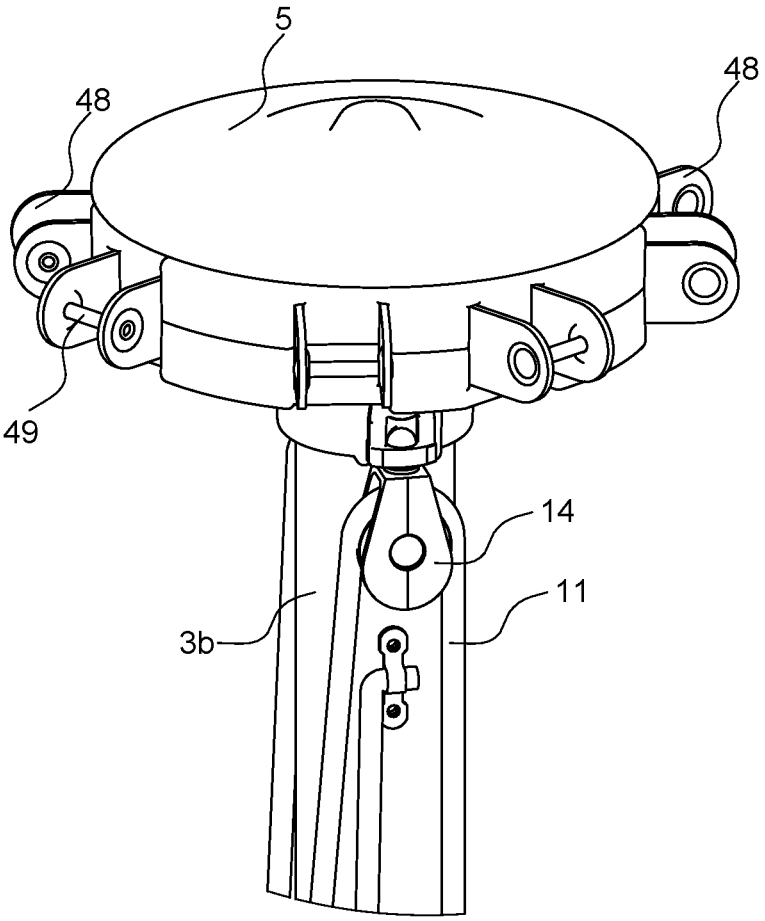
FIG. 7 shows a perspective view illustrating portion 37A of the structure of the parasol fan illustrated in FIG. 6, the depiction illustrates the upper hub.
Figure 8:
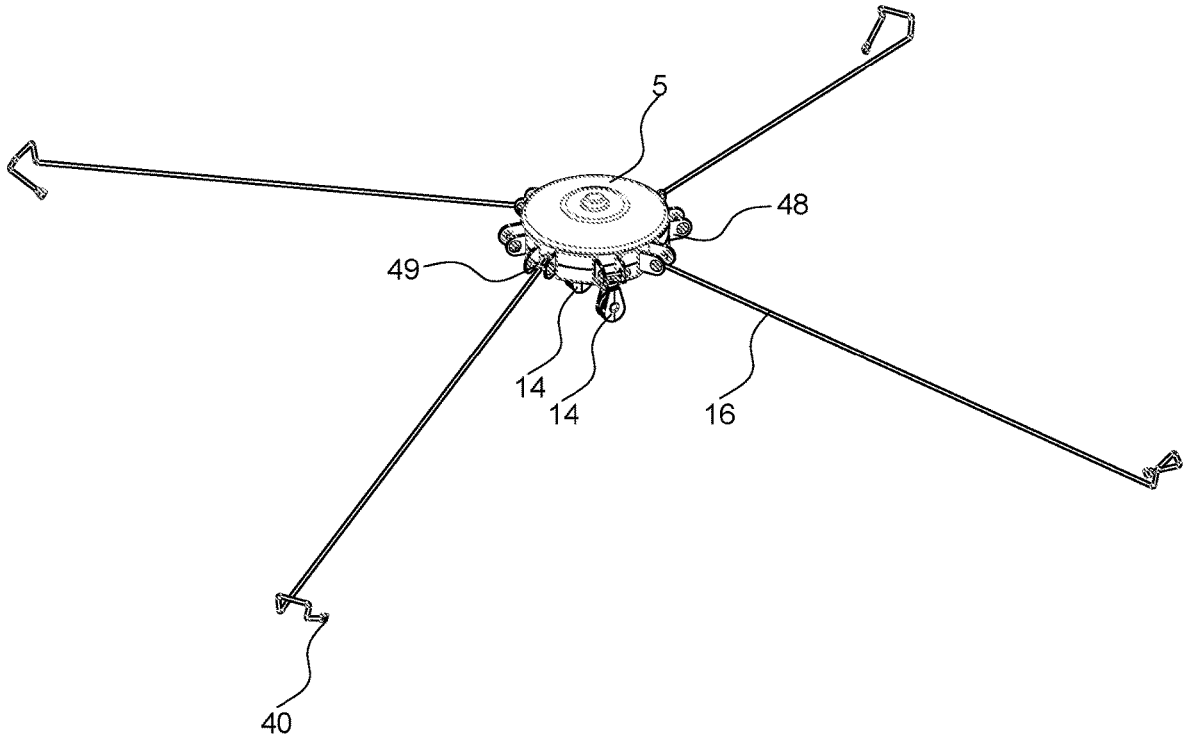
FIG. 8 shows a perspective view illustrating the upper hub and electrical wiring.
Figure 9:
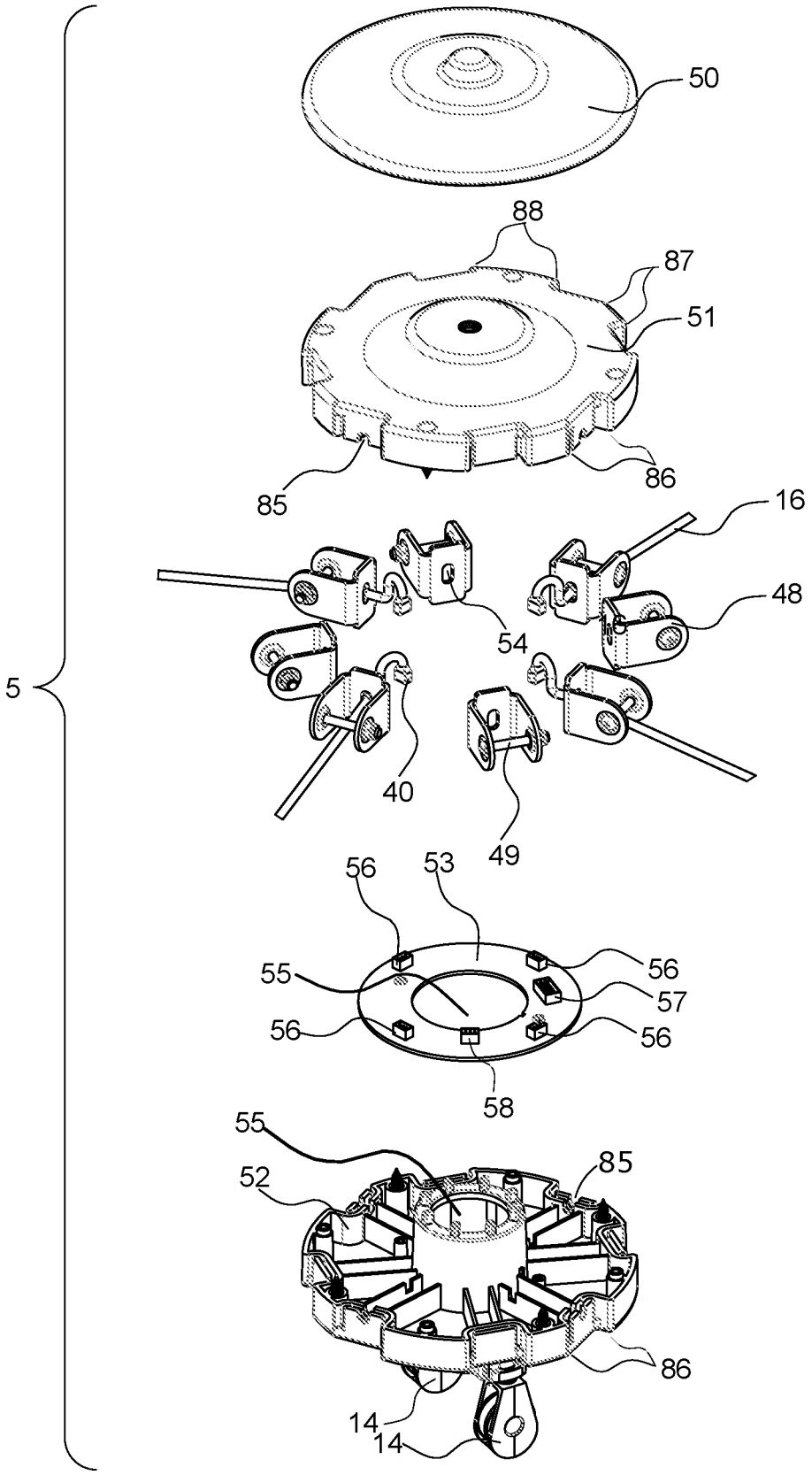
FIG. 9 is an exploded view of the upper hub.

Depiction of portion 37A is illustrated in FIG. 7. The upper hub 5 comprise bracket 48 comprising pins 49 designed for pivotal attachment to opposing openings 44. Pin 49 may be any applicable securing means. Pulley 14, and a rope 11 coupled to it, is depicted. An example of the upper hub 5 is further depicted in FIG. 8, showing multiple electrical wiring 16 coming out of the upper hub 5, each electrical wiring comprising an electrical connector 40. FIG. 9 is an exploded view of the presently disclosed upper hub 5 depicting cap 50, top cover 51, and bottom cover 52. The bottom cover 52, comprises two opposing pulleys 14. The upper hub 5 comprises a plurality of brackets 48 comprising pins 49. The number of brackets 48 corresponds to the number of ribs 7 that the parasol fan structure/assembly 99, 100 comprises. In the illustrated examples herein, the parasol fan structure/assembly 99, 100 comprises eight ribs 7, and four of the eight ribs 7 are pivotally attached to struts 6*a* which are attached to the attachable fan device 12. In some embodiments, the ribs 7 which are pivotally attached to strut 6 and the ribs 7 which are pivotally attached to ribs 6*a* alternate.

In some embodiments, the upper hub 5 comprises a PCB 53 and electrical wiring 16 from the control unit 13 electrically connects to the PCB 53. In the embodiment of FIG. 9, the PCB 53 comprises an electrical connector 57 designed for electrical connection to the electrical wiring 16 from the control unit 13, and electrical connectors 56 electrically connected to electrical connector 57. Electrical connectors 56 in turn electrically connect to electrical connectors 40 of the electrical wiring 16 coming out of the upper hub 5 and running along, or inside, ribs 7. Bottom cover 52 and PCB 53 comprise a central opening 55. The central opening 55 is designed to fit an end of the pole portion 3*b* inside the upper hub 5 and to allow electrical wiring 16 from the control unit 13 to enter the upper hub 5. In some embodiments, according to which the upper hub 5 does not comprise a PCB 53, electrical wiring 16 from the control unit 13 enters the upper hub 5 via opening 55 and from there it runs along, or inside, each rib 7 which is pivotally attached to strut 6*a*. in the embodiment illustrated, electrical wiring 16 from the control unit 13 enters the upper hub 5 via opening 55 and there it electrically connects to electrical connector 57. Electrical wiring 16 comprising electrical connectors 40 electrically connect to electrical connectors 56 and pass through openings 54 in brackets 48 to runs along, or inside, each rib 7 which is pivotally attached to strut 6*a*. Further, when top cover 51 and bottom cover 52 are assembled they define between then openings 85 for the passage of the electrical wiring 16, wherein wiring 16 passed first through opening 54. In some embodiments, PCB 53 further comprises electrical connector 58 which is further discussed herein.

Top cover 51 and bottom cover 52, when assembled together, define ridges 88, 89. And, ridges 88, 89 define between them grooves 86, from which bracket 48 projects outside of the top hub 5. It is noted, that the sides/walls of grooves 86 are not even, and therefore brackets 48 are projected outside of the top hub in an offset angle. Therefore, the ribs 7 pivotally attached to the brackets 48 via pins 49 are also at an offset angle relative to the center pole 3*a*, 3*b*, meaning that a line running along the top, or inside, of rib 7, and projecting straight from it, would not pass through the center point, or substantially center point, of pole portion 3*b* or the center point, or substantially center point, of the upper hub 5. Similarly, the top cover 80 and bottom cover 81 of the lower hub 4 (FIG. 29), when assembled together, define ridges 88, 89 which are vertically parallel to ridges 88, 89 of the upper hub 5. Ridges 88, 89 of the lower hub 4 define between them grooves 86, from which bracket 48 projects outside of the lower hub 4. As with the upper hub 5, the sides/walls of grooves 86 are not even, and therefore brackets 48 are projected outside of the top hub in an offset angle. Grooves 86 of the upper hub 5 and grooves 86 of the lower hub 4 parallel each other in shape vertically. Therefore, also the struts 6, 6*b* which pivotally attached to the brackets 48 of the lower hub 4 via pins 49 are at an offset angle relative to the center pole 3*a*, 3*b*, meaning that a line running along the top, or inside, of strut 6, 6*b* and projecting straight from it, would not pass through the center point, or substantially center point, of pole portion 3*b* or the center point, or substantially center point, of the lower hub 4. The offset angle of ribs 7 and the offset angle of struts 6, 6*b* are similar, or the same. The offset angle attachment described and depicted serves to create a space for the motor 20 (and housing 19) and allow the parasol fan structure/assembly 99, 100 to close in the smallest diameter possible.

In some embodiments, ridges 88 and ridges 89 are not equal in length. In the embodiment shown (FIGS. 9 and 29), ridges 89 are longer (horizontally) than ridges 88. In the embodiment shown, on the first side of each ridge 88, the first side bordering the shallower side/wall of groove 86, there is a rib 7 pivotally attached to a strut 6*a* which is attached to an attachable fan device 12, while on the other side of each shorter ridge 88, there is a rib 7 pivotally attached to a strut 6 which is not attached to an attachable fan device 12. Thus, in some embodiments, the presently disclosed parasol fan structure/assembly 99, 100 comprises multiple pairs of ribs 7, each pair comprises one rib 7 which is pivotally attached to a strut 6 which is not attached to an attachable fan device 12 and one rib 7 which is pivotally attached to a strut 6*a* which is attached to an attachable fan device 12, and there is a bigger space between the pairs than there is between the ribs 7 in a pair. The uneven spacing described and depicted also serves to create space for the motor 20 (and housing 19) and allow the parasol fan structure/assembly 99, 100 to close in the smallest diameter possible.

Figure 10:
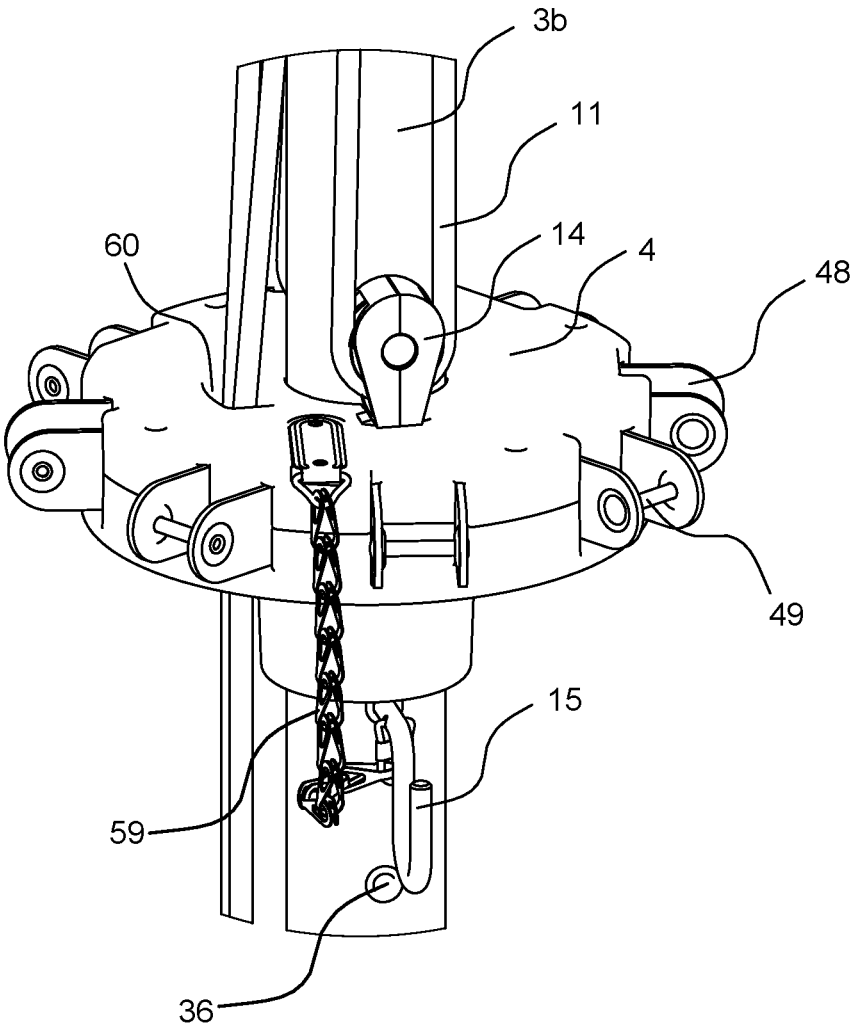
FIG. 10 shows a perspective view illustrating portion 38A of the structure of the parasol fan illustrated in FIG. 6, the depiction illustrates the lower hub.

Referring now to FIG. 10, portion 38A is illustrated depicting the lower hub 4 comprising pulleys 14, the pulleys 14 coupled to rope 11. In some embodiments, the lower hub 4 comprises an aperture 60 for the passage of the rope 11 through the lower hub 4. The lower hub comprises a plurality of brackets 48 comprising pin 49 designed for pivotal attachment to struts 6 and strut portions 6*b* via opposing openings 45. The lower hub 4 and upper hub 5 have the same number of brackets 48. The lower hub 4 comprises pin 15 used to secure the lower hub 4 in a pre-determined position on pole portion 3*b*, the position relative to the upper hub 5. The pin 15 is attached to the lower hub 4 by chain 59 and is designed to fit in opening 36 in pole portion 3*b*. In some embodiments, there is a plurality of openings 36, each opening 36 defines a pre-determined configuration of the parasol fan structure/assembly 99, 100, for example, an open configuration or a closed configuration. In some embodiments, the presently disclosed parasol fan structure/assembly 99, 100 comprise several pre-determined open configurations and therefore several positions of openings 36. Each pre-determined open configurations defines a degree of the expansion of the ribs 7 with relation to a center pole or pole portion 3*b*. Each pre-determined open configurations also defines an angle of struts 6*a*, 6*b* with relation to a center pole or pole portion 3*b* and thus the position of the attachable fan device 12 with relation to a user using the parasol fan structure/assembly 99, 100. Thus, a user may configure the parasol fan structure/assembly 99, 100 in a plurality of open configurations, to adjust the position of the attachable fan device 12 and therefore the direction of the air flow produced by the attachable fan device 12 as desired. FIG. 10 features two open configurations as defined by the two openings 36 illustrated. Possible configurations of the parasol fan structure/assembly 99, 100 are further discussed herein.

Figure 11:
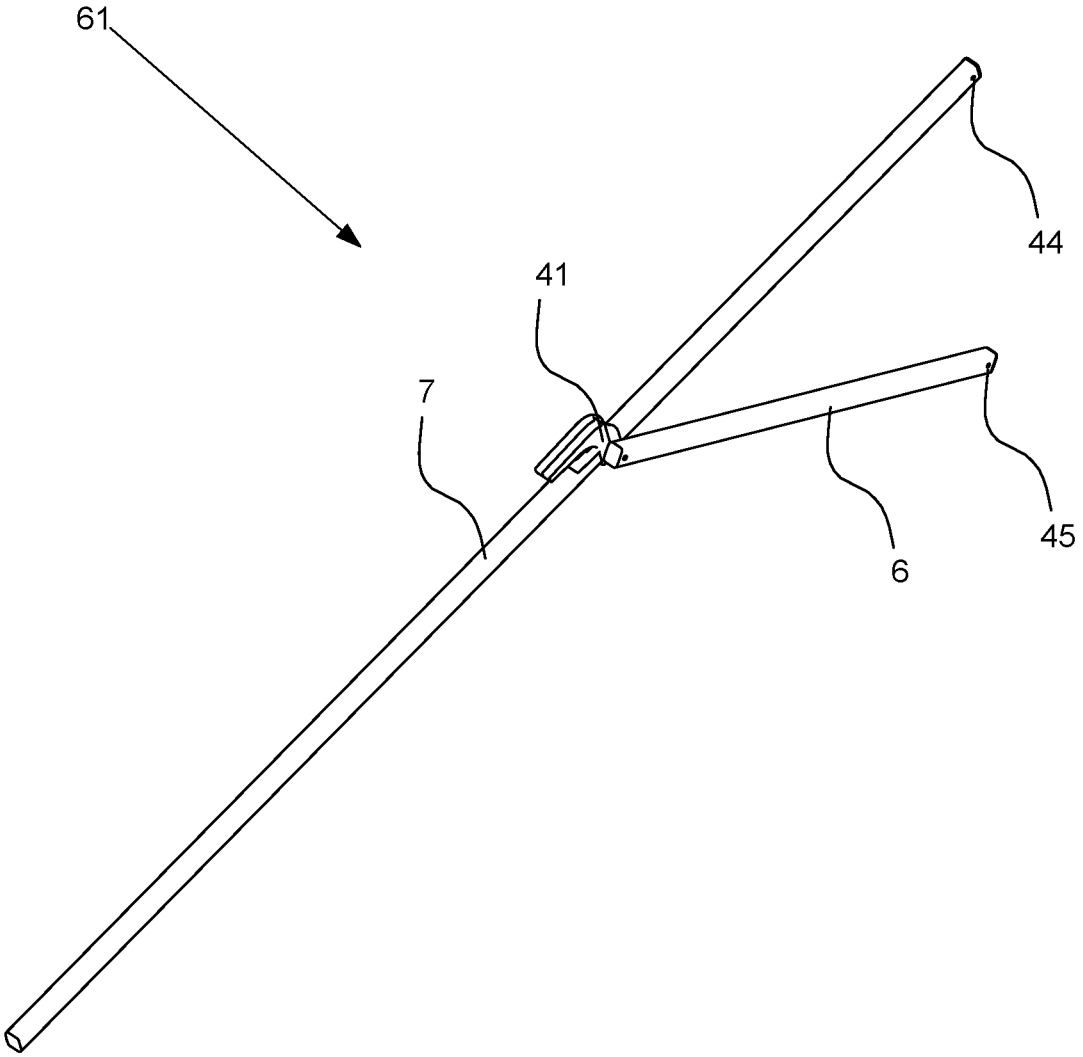
FIG. 11 shows a perspective view illustrating a rib attached to a strut.
Figure 12:
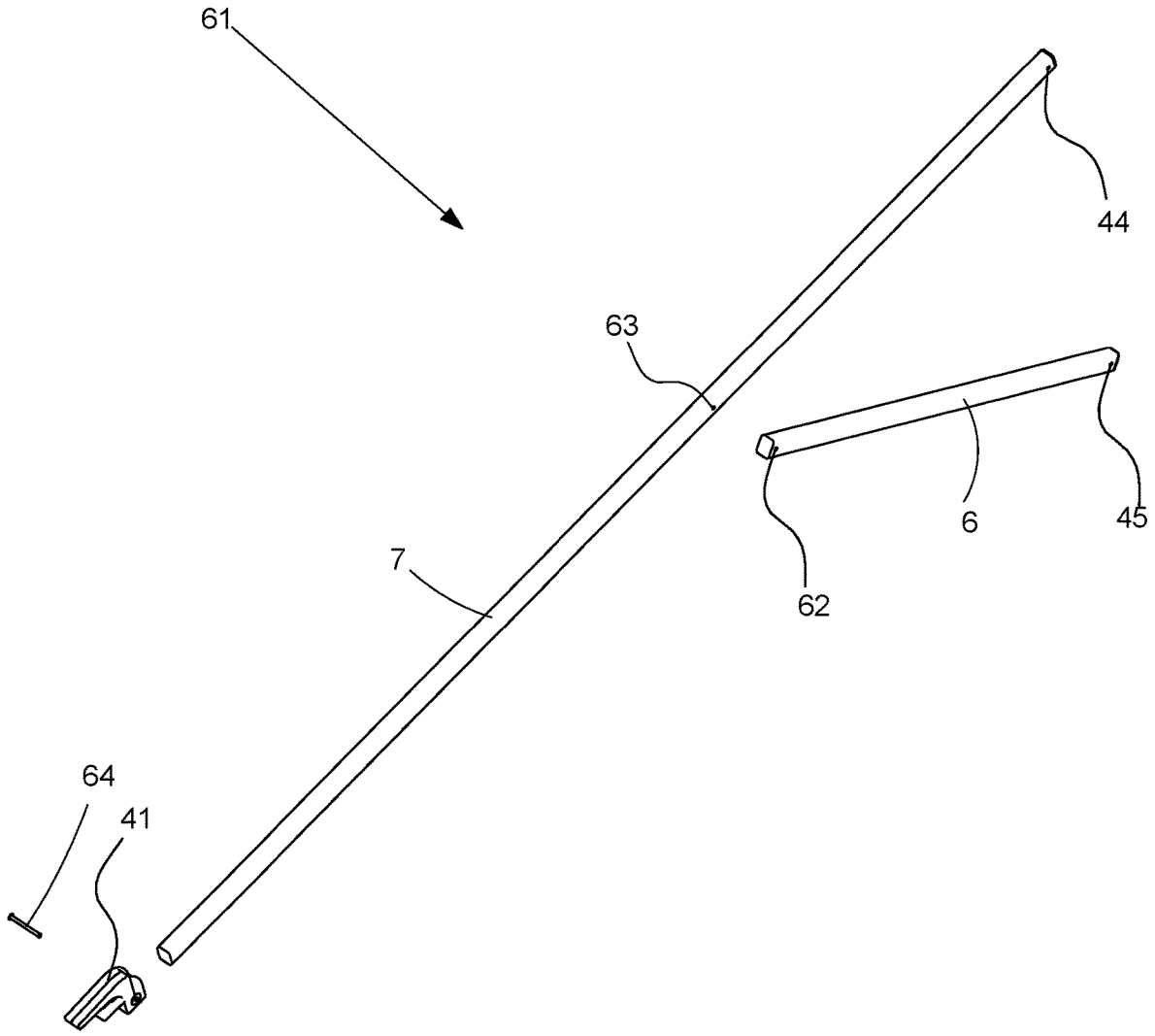
FIG. 12 shows an exploded view of the rib and strut assembly of FIG. 11.

FIGS. 11 and 12 depict assembly 61 comprising rib 7, strut 6, and joint 41. Joint 41 is designed to strap rib 7 and pivotally attach it to strut 6 employing pin 64 which goes through opposing openings 63 and 62 on rib 7 and strut 6, respectively. Generally, a pin is interchangeable with any other securing means according to the present disclosure. In some embodiments (not shown), assembly 61 does not comprise joint 41, and strut 6 is pivotally attached to rib 7 via a pin 64 which goes through opposing openings 63 and 62 on rib 7 and strut 6, respectively, thus pivotally securing them together.

Figure 13:
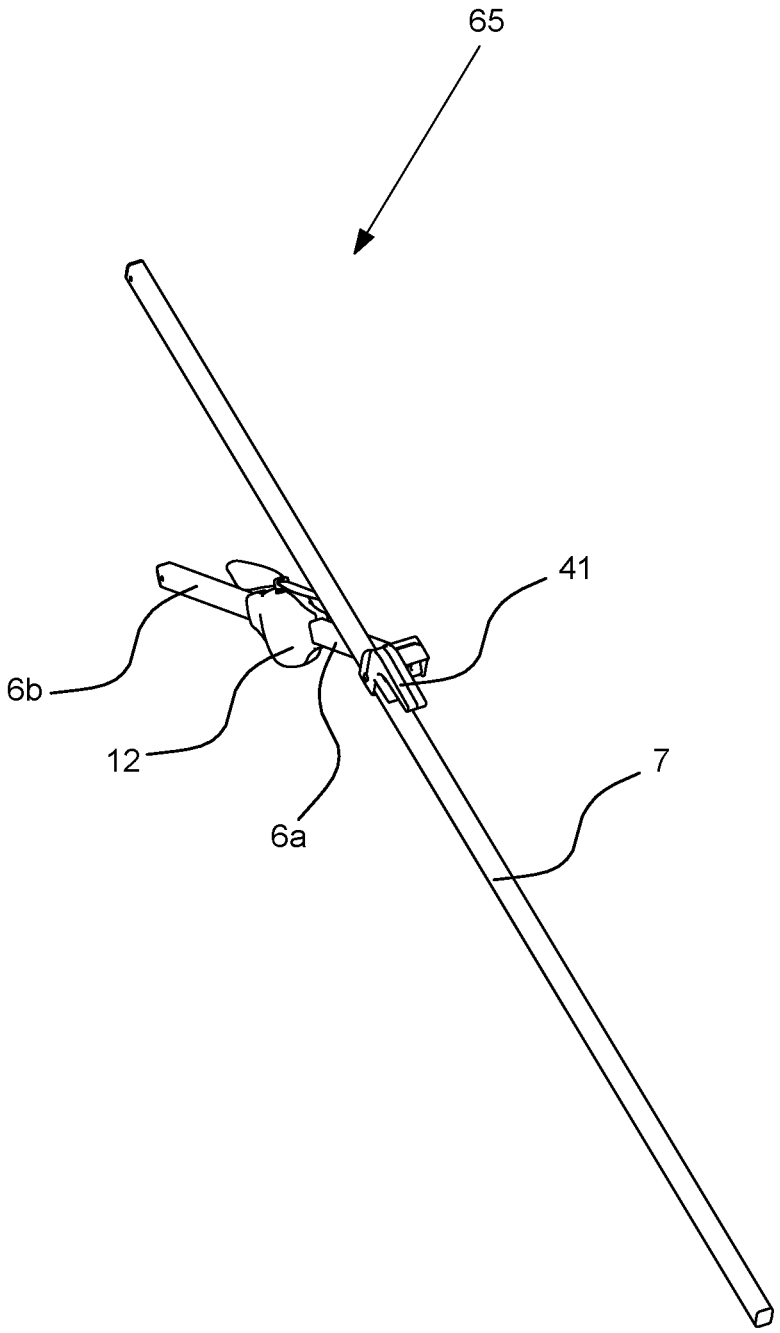
FIG. 13 shows a perspective view illustrating a rib pivotally attached to a strut which comprises the presently disclosed attachable fan device.
Figure 14:
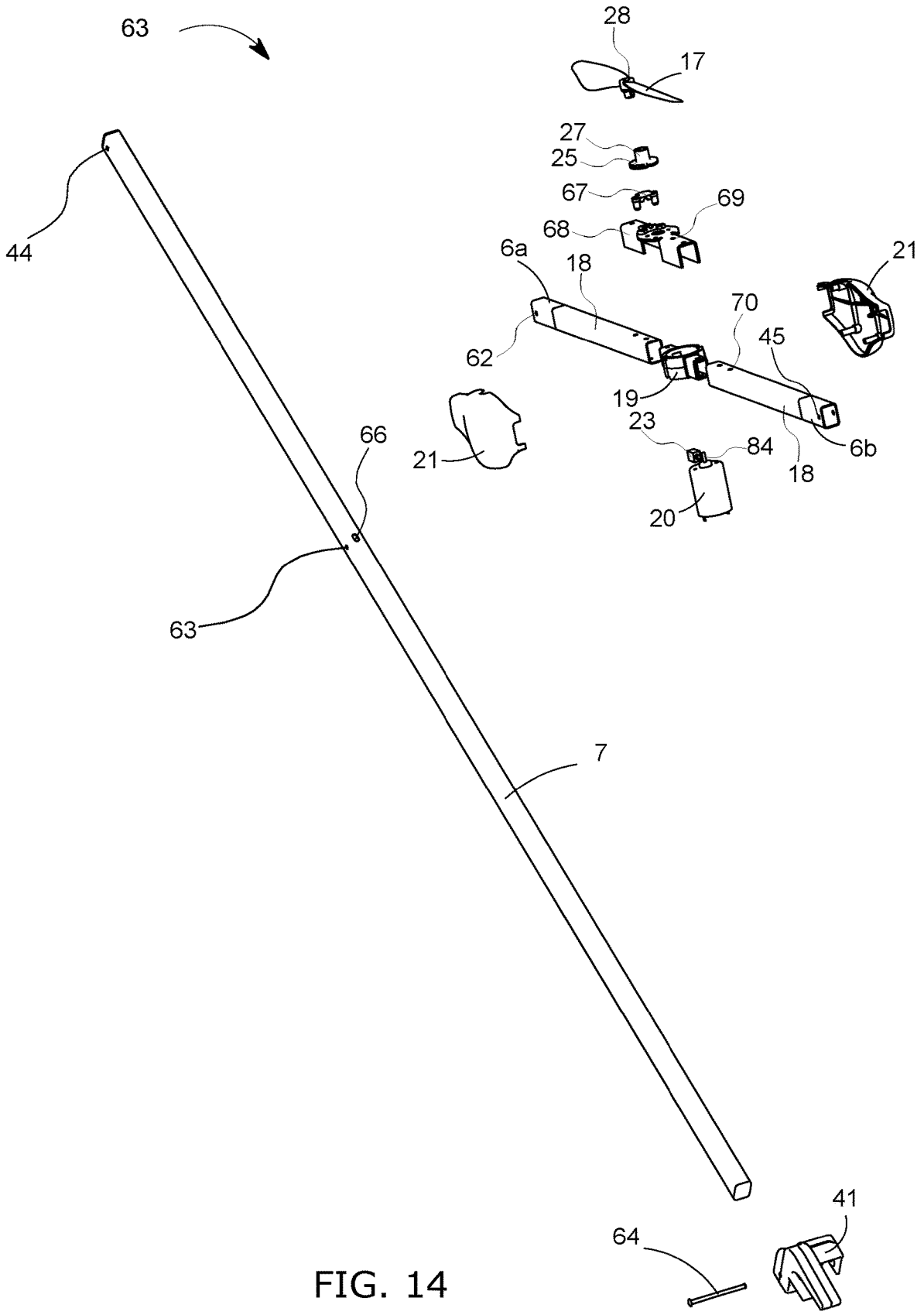
FIG. 14 shows an exploded view of the rib pivotally attached to the strut which comprises the presently disclosed attachable fan device of FIG. 13.

FIGS. 12 and 13 depict assembly 65 comprising rib 7, struts 6*a*, 6*b*, attachable fan device 12, and joint 41. Joint 41 is designed to strap rib 7 and pivotally attach it to strut 6*a* employing pin 64 which goes through opposing openings 63 and 62 on rib 7 and strut 6*a*, respectively. In some embodiments, rib 7 of assembly 65 further comprises opening 66 usable for the passage of electrical wiring 16 from inside rib 7 to run along, or inside, strut 6*a*, and then electrically and operably connect to attachable fan device 12. An embodiment of the components of the attachable fan device 12 is depicted. According to the example of FIG. 14, the attachable fan device 12 comprises a housing 19 which partially encases an electric motor 20 comprising a shaft 84 which rotates when the electric motor 20 is powered by electricity. In some embodiments, the attachable fan device 12 further comprises an electric actuator 23 which electrically connected to the electric motor 20 and operably connected to a biased pin 24 (depicted in FIG. 15). In some embodiments, the attachable fan device 12 further comprises a notched disk 25. The notched disk comprises at least one notch 26 on its perimeter (depicted in FIG. 15), the notch is designed to receive the biased pin 24. In some embodiments, the notched disc 25 further comprises a tubular shaft 27. The tubular shaft 27 is designed to be attached to, and be operably connected to, the shaft 84 of the electric motor 20. The presently disclosed attachable fan device 12 further comprises a fan component, the fan component comprises two fan blades 17 and a center hub 28 therebetween. The center hub 28 is designed to be operably attached to the tubular shaft 27 in such manner that the fan blades 17 are substantially parallel to the at least one notch 26.

In some embodiments, when the electric motor 20 is powered by electricity, the electric actuator 23 actuates to retract the biased pin 24 from a protruded position in which the biased pin 24 is inserted in the notch 26 to retracted position in which the biased pin 24 is outside the notch 26, thus allowing the notched disk 25 to rotate and in turn rotate the fan blades 17. However, when the electric motor 20 is not powered by electricity, the electric actuator 23 releases the biased pin 24 from the retracted position allowing the biased pin 24 to enter the notch 26, thus preventing the notched disk 25, and in turn the fan blades 17, from rotating. Since, the connection of the fan components 28, 17 to the tubular shat 27 is such that the fan blades 17 are substantially parallel to the at least one notch 26, it means that when the fan blades' rotation ceases, the fan blades 17 are positioned substantially parallel to the notch. In some embodiments, the notched disk 25 comprises a pair of opposing notches 26.

In some embodiments, the attachable fan device 12 further comprises two opposing parasol attachments 18. In some embodiments, the parasol attachments 18 are tubular and have a first end and a second end. The first end of each parasol attachment 18 is attached to the fan component housing 19 (also referred to herein as housing), and the parasol attachments 18 are substantially parallel to the biased pin 24. In some embodiments, the attachable fan device 12 further comprises a top mounting bracket 67 and a bottom mounting bracket 68. The top mounting bracket 67 and a bottom mounting bracket 68 are designed to hold the actuator 23, and biased pin 24, in between them and in a position parallel to the parasol attachments 18. In some embodiments, the top mounting bracket 67 clips onto the bottom mounting bracket 68, and the bottom mounting bracket 68 is secured to the parasol attachments 18 via a securing means going through overlapping openings 69 and 70. In some embodiments (depicted in FIG. 14), the second end of one parasol attachment 18 attaches directly to strut portion 6*a* while the second end of the other parasol attachment 18 attaches directly to strut portion 6*b*. In some embodiments, components of the attachable fan device 12, such as motor 20, actuator 23, biased pin 24, housing 19, top mounting bracket 67, bottom mounting bracket 68, part of the notched disc 25, and/or part or entire parasol attachments 18 are encase by motor housing 21.

Figure 15:
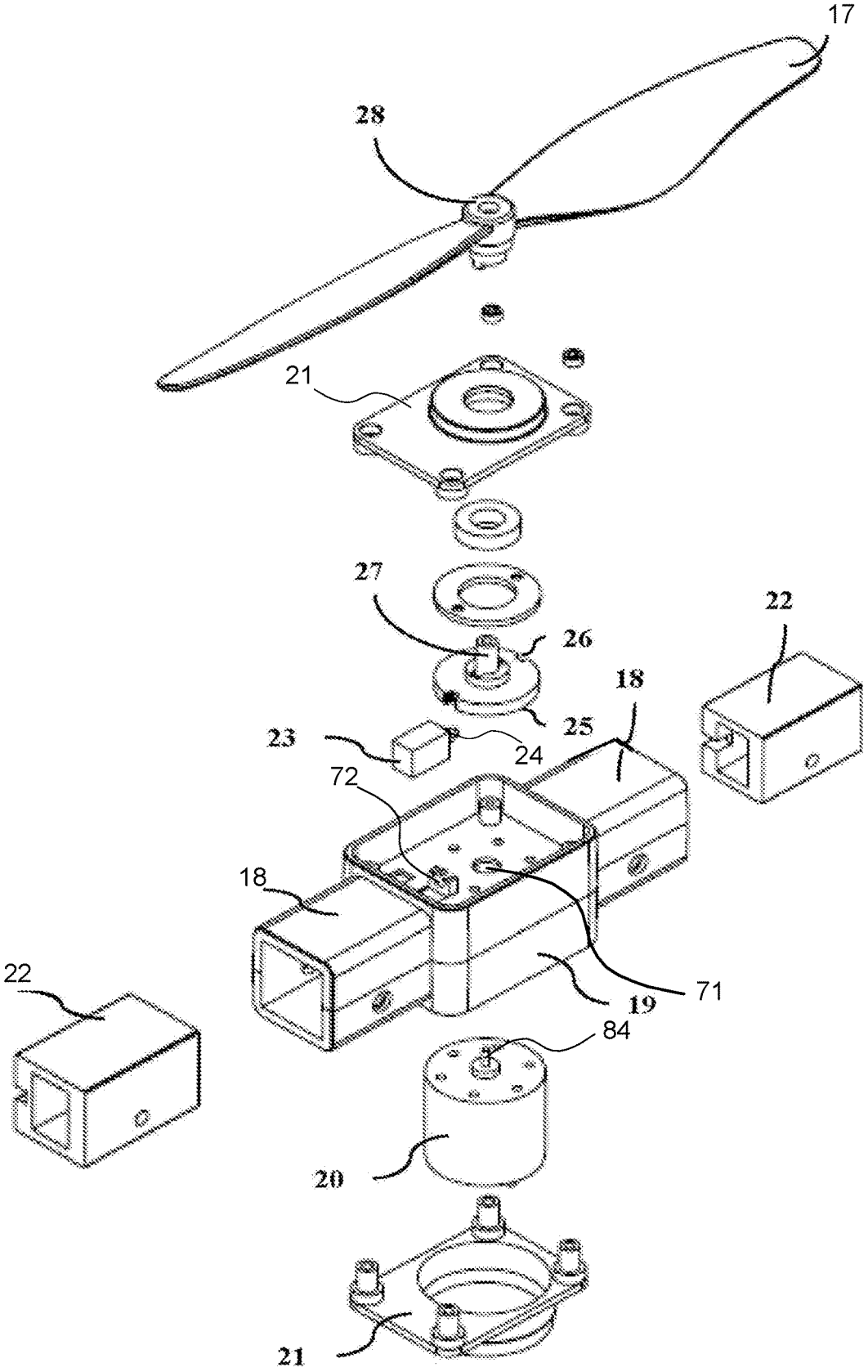
FIG. 15 shows an exploded view illustrating the presently disclosed attachable fan device.

FIG. 15 illustrates an exploded view of another embodiment of the presently disclosed fan device 12. The attachable fan device 12 includes fan components 28, 17 directly, or indirectly, attached to parasol attachments 18. The parasol attachments 18 is configured to attach the fan components 28, 17 to a structure, such as a structure of a parasol or an umbrella. Components of the fan components 28, 17 are operably attached to an electric motor 20 which is partially encased in a housing 19. In some embodiments, the housing 19 comprise a surface comprising opening 71 for the shaft 84 of the electrical motor 20, the surface comprising walls along its perimeter. In some embodiments, the housing 19 further comprises groove 72 designed to fit biased pin 24 in a position parallel to parasol attachments 18. In some embodiments, the housing 19 further yet comprises an opening, proximal to grove 72, the opening designed to allow the electrical connection/wiring of the electrical actuator 23 to the electrical motor 20. The electrical motor 20 is secured to the housing 19 by way of motor housing 21 which encases the motor 20 and other components of the attachable fan device 12. In some embodiments, the parasol attachments 18 includes parasol attachment inserts 22 which may be particularly sized and shaped to configure the parasol attachments 18 for attachment to a correspondingly particularly sized and shaped structure, e.g., a strut 6*a*, 6*b* with a particular size and shape. An actuator 23 (e.g., electric solenoid actuator 23) is electrically, and operably, connected to the moor 20 and operates a pin ("biased pin") 24 that is biased toward a notched disk 25 that contains one or more notches 26 thereon. The notched disk 25 is affixed to the electric motor shaft 84, and in tum is attachable to the center hub 28 which joins the blades 17 of the attachable fan device 12. During an operation of the electric motor 20, the shaft 84 is rotated and the notched disk 25 and the rotatable fan blades 17 also rotate, and the electric actuator 23 actuates to retract the biased pin 24 from a protruded position to a retracted position and to hold the biased pin 24 in the retracted position. When the operation ceases, the electric actuator (e.g., a solenoid actuator) 23 releases the biased pin 24 which enters the protruded position and enters the notch 26 of the notched disk 25, causing the notched disk 25, the shaft 27, and the rotatable fan blades 17 cease rotation and enter a halted position. The notches 26 of the notched disk 25 are then positioned adjacent, or parallel, to portions of the strut 6*a*, 6*b* and fan blades 17 are prevented from rotating beyond a parallel configuration with the portions of the strut 6*a*, 6*b* of the parasol fan structure/assembly 99, 100 or umbrella. In this manner, the attachable fan device 12 may be left attached to the parasol fan structure/assembly 99, 100 or umbrella before, during, and after use, and the blades 17 of the attachable fan device 12 do not interfere with and are not damaged by a closing parasol fan structure/assembly 99, 100 or umbrella. This convenience greatly facilitates setup and takedown for staff and other individuals involved with maintenance or use of the assembly.

In some embodiments, a biased pin 24 may be mechanically biased with a spring, for example, or may be biased as part of a built-in mechanical bias of the actuator 23 that is in effect when the actuator 23 is passive, i.e., not actuated. The biased pin 24 is insertable into a notch 26 of the notched disk 25 and is retractable by an actuator 23, such as an electric actuator 23, for example a solenoid actuator. During operation of the attachable fan device 12 and rotation of the fan blades 17, as occurs as a result of a user switching the attachable fan device 12 on, the shaft 27 and the notched disk 25 also rotate, and the actuator 23 actively retracts the biased pin 24 to overcome a bias of the biased pin 24 which enters a retracted position to allow the notched disk to rotate freely. When the operation is concluded, as occurs as a result of a user switching the attachable fan device 12 off, the actuator 23 releases the biased pin 24 which succumbs to its bias and enters a protruded position. The biased pin 24 may contact portions of the notched disk 25 as it rotates. The protruded biased pin 24 enters the notch 26 of the notched disk 25 and stops the notched disk 25 from rotating further which, therefore, causes the shaft 27 and the fan blades 17 to also stop rotating. The fan blades 17 then would be positioned directly over the notches 26, and as the notched disk 25 comes to rest, the notches 26 and the fan blades 17 would be oriented parallel or at least mostly parallel with strut portions 6*a*, 6*b*.

Figure 16:
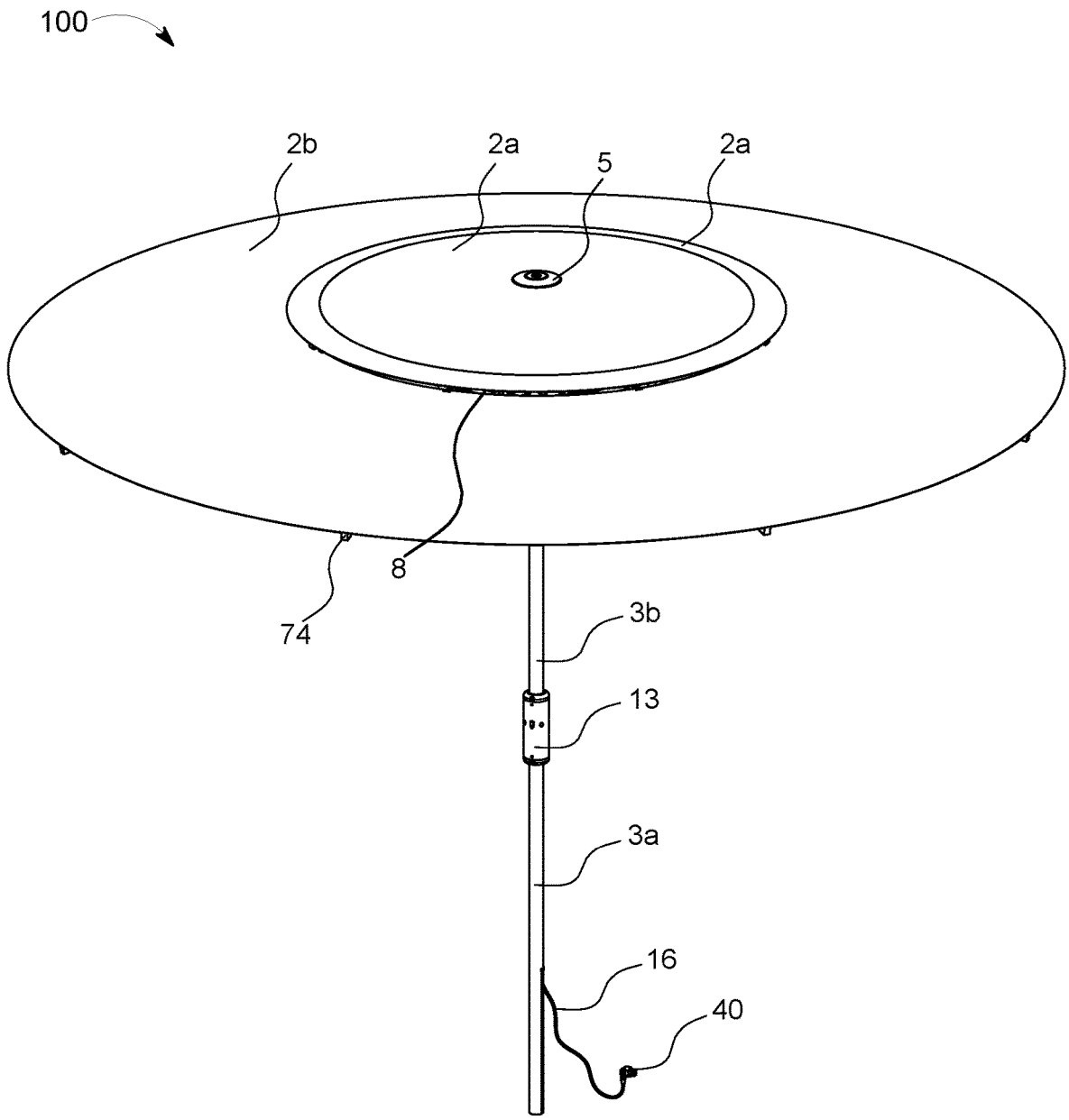
FIG. 16 shows a top perspective view illustrating the presently disclosed parasol fan assembly.
Figure 18:
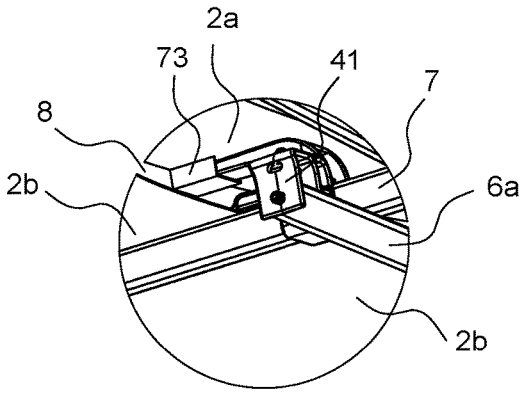
FIG. 18 is a partial perspective view illustrating portion 39A of the parasol fan assembly of FIG. 17.

Referring now to FIGS. 16 and 17, the parasol fan assembly 100 is illustrated. The parasol fan assembly 100 generally comprises the presently disclosed parasol fan structure 99 and any type of applicable canopy 2*a*, 2*b*. For example, the canopy 2*a*, 2*b* may be designed as one continuous piece (which may include various features, such as, aperture/s) or designed as multiple pieces which may have gaps between them. The gaps, or apertures, may serve as vents to allow air flow for the operation of the attachable fan device/s. The para sol fan assembly 100 is depicted in a pre-determined open configuration, for example, a fully open pre-determined configuration in which the canopy 2*a*, 2*b* is in the most expanded, horizontal-wise, pre-determined open configuration. Air circulation for the operation of the attachable fan devices 12 is provided by ambient air present all around the parasol fan assembly 100, and, also from above the parasol fan assembly 100 via vent 8 which is basically the gap between canopy 2*a* and canopy 2*b*. Vent 8 allows for air circulation from above the fan parasol assembly 100. While one embodiment of vent 8 is depicted, one skilled in the art will appreciate that venting of a parasol canopy can be done in a variety of methods. Some examples, relevant especially to the embodiment according to which the parasol fan assembly's canopy 2*a*, 2*b* is one continuous canopy, include aperture/s of any number, size, or shape in the canopy/canopies 2*a*, 2*b*. Portion 39A in FIG. 17 is depicted in FIG. 18, illustrating the joint 41 pivotally attaching strut 6*a* (or 6 for the neighboring rib 7) to rib 7, an end of joint 41 is inserted into a pocket 73. Pockets 73 are positioned along the outer circumference of canopy 2*a*, and joints 41 reversibly attached to them keep canopy 2*a* attached to the parasol fan structure 99. Similarly, pockets 74 are positioned along the outer circumference of canopy 2*b* and the ends of ribs 7 which are distal from the upper hub 5 are reversibly attached to them, and thus keep canopy 2*b* attached to the parasol fan structure 99.

Figure 19:
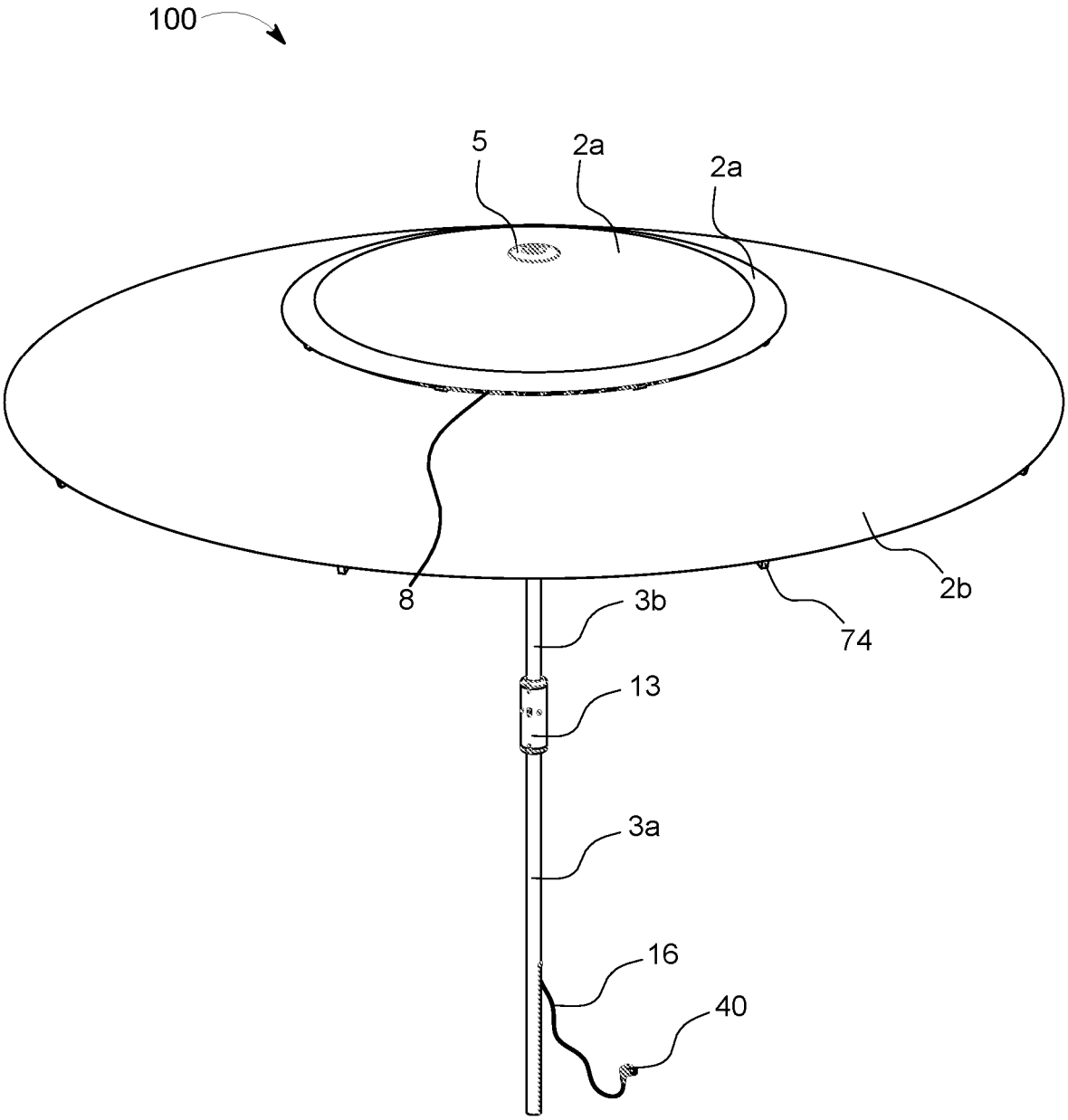
FIG. 19 is another top perspective view illustrating the presently disclosed parasol fan assembly.
Figure 20:
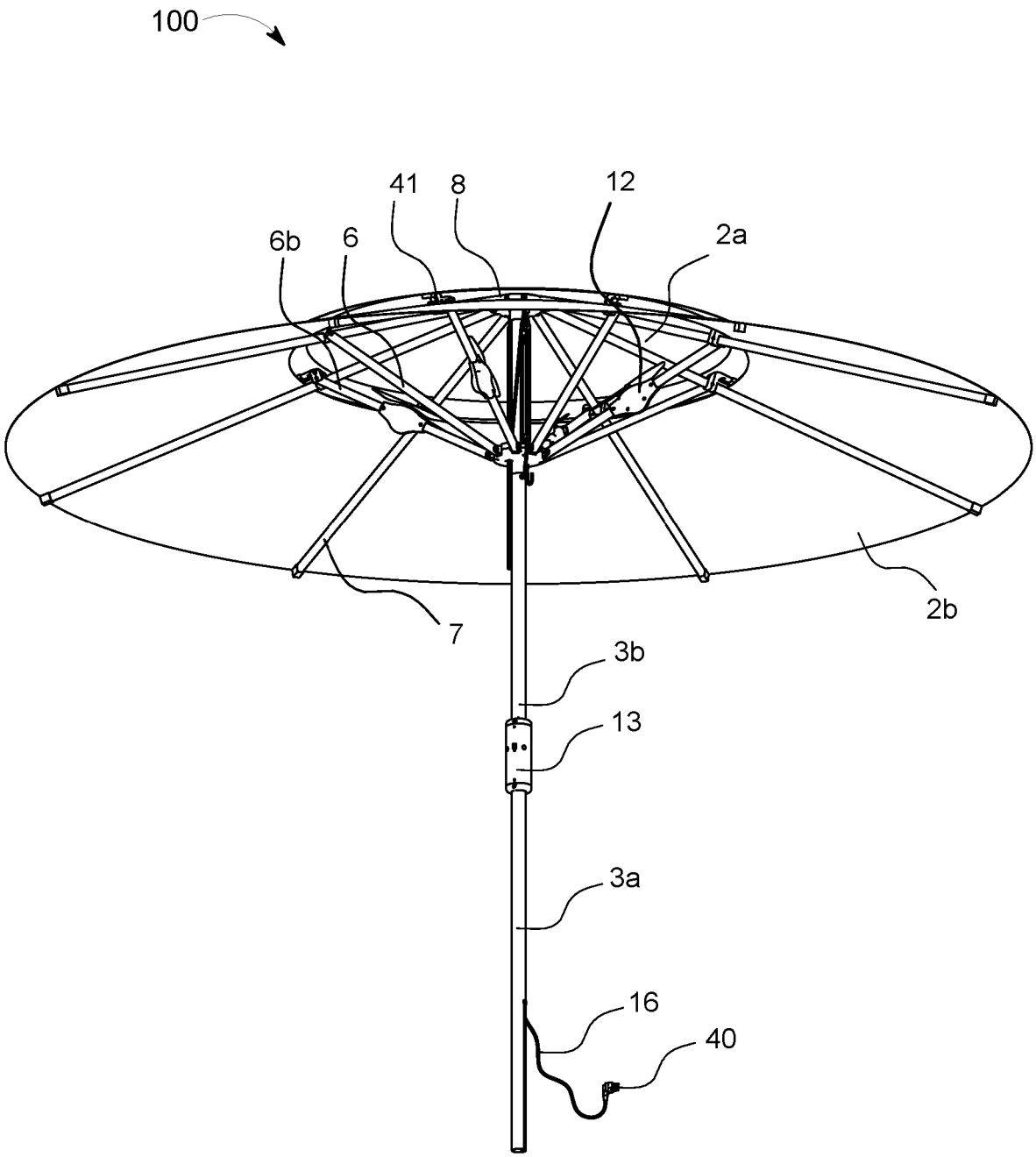
FIG. 20 is another bottom perspective view illustrating the presently disclosed parasol fan assembly in an open configuration.
Figure 21:
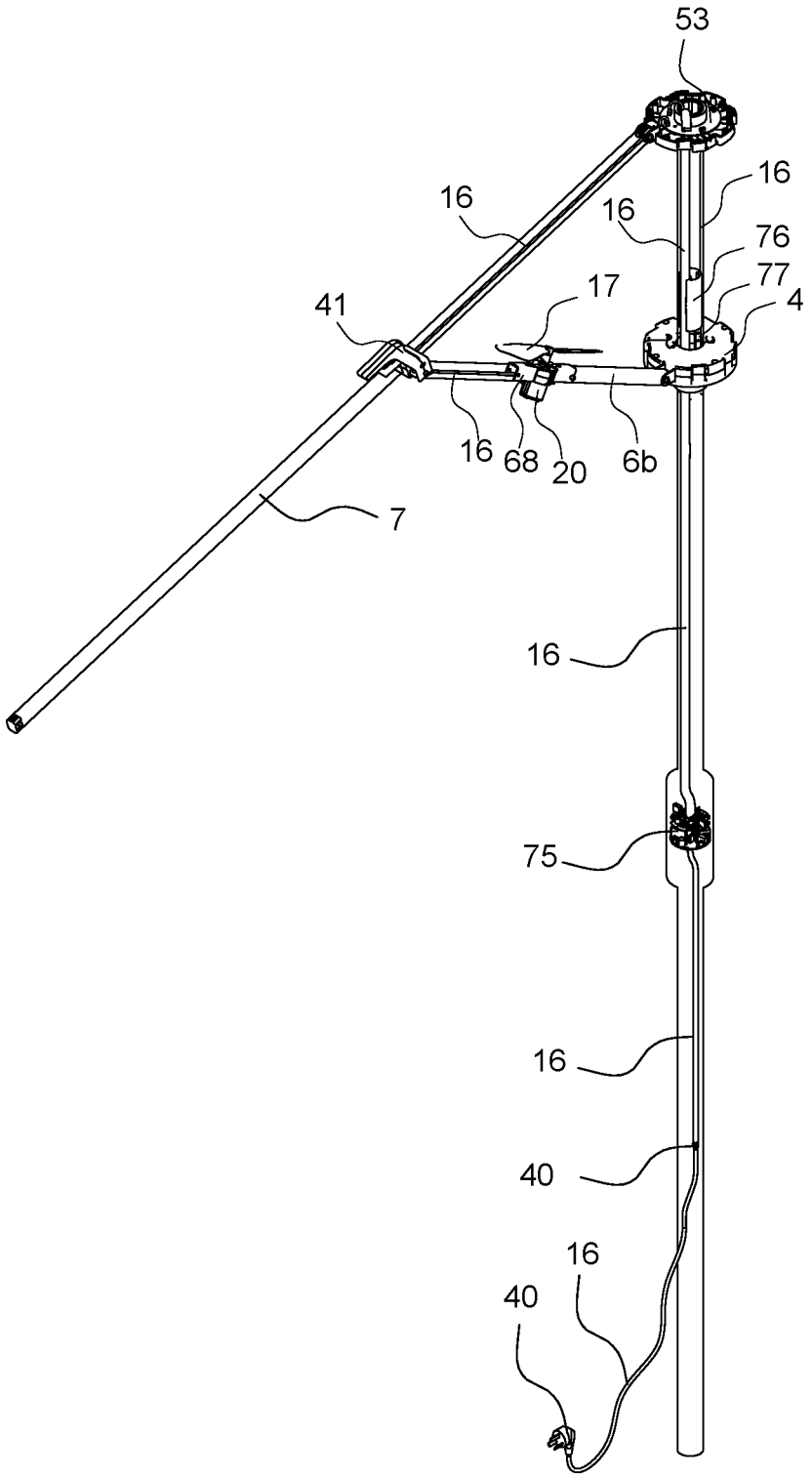
FIG. 21 is a cut away view illustrating electrical wiring of the presently disclosed parasol fan structure.
Figure 22:
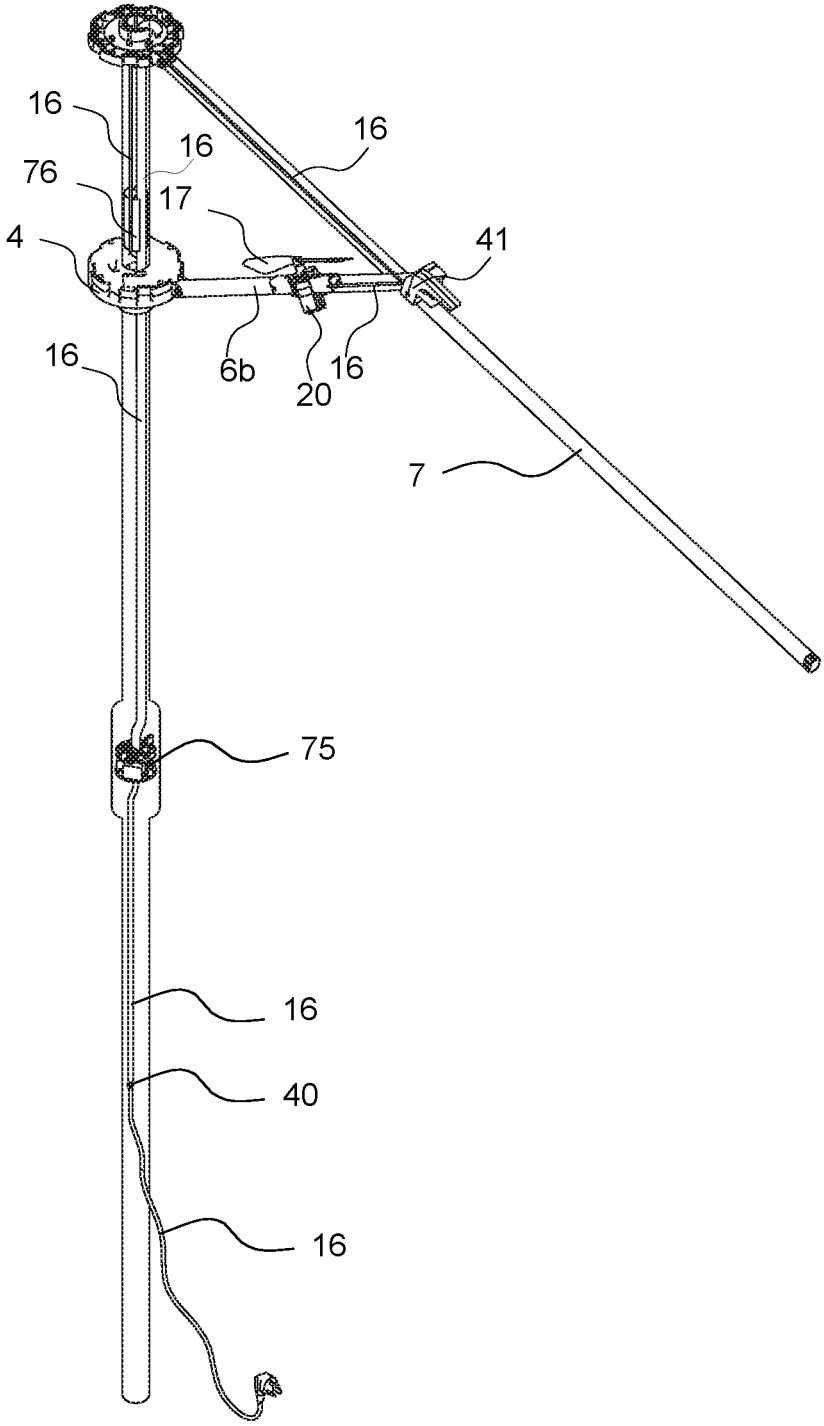
FIG. 22 is another cut away view illustrating electrical wiring of the presently disclosed parasol fan structure.

FIGS. 19 and 20, illustrate the parasol fan assembly 100 in a pre-determined open configuration, for example, a pre-determined open configuration in which the canopy 2*a*, 2*b* is not in the most expanded, horizontal-wise, pre-determined open configuration. In such open configuration, canopies 2*a*, 2*b* are positioned in a narrower angle relative to pole portion 3*b*, compared to what the angle would be in a fully open pre-determined configuration, for example, the configuration depicted in FIGS. 16 and 17. The presently disclosed parasol fan assembly 100 comprise a plurality of pre-determined open configurations, in some embodiments, three pre-determined open configurations. In each pre-determined open configurations, the position and angle of the attachable fan device/s 12 relative to a user underneath the canopy 2*a*, 2*b* is different. Thus, a user can choose an open configuration which directs fanned air in a preferred manner. In each of the pre-determined open configurations of the parasol fan assembly 100, vent 8 supplies air circulation from above the canopy 2*a*, 2*b* and thus allows the attachable fan device/s 12 to work efficiently.

Figure 28:
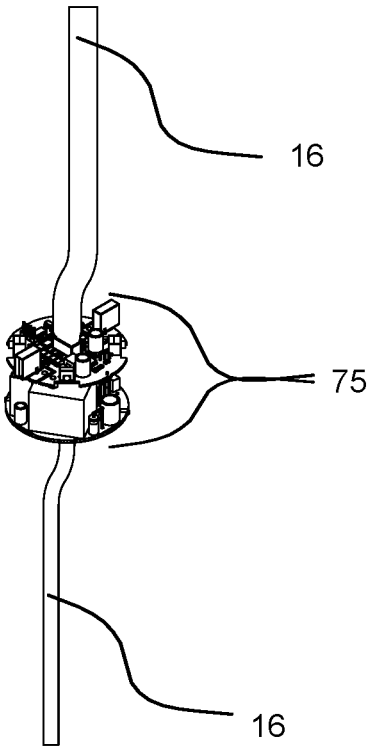
FIG. 28 is a cut away view illustrating components of the control unit.

Control unit 13 is depicted in FIGS. 16, 17, 19, and 20. The exemplary control unit 13 includes a body with a plurality of buttons 33 (also referred to herein as switches 33 thereon and a control circuitry 75. The switches 33 and port 32 are operably connected to control circuitry 75 (control circuitry 75 is depicted in FIG. 28) of the control unit 13 for control of the attachable fan device/s 12. The control unit 13, as shown, also includes a charge port 32 to allow a user to charge a personal electronic device, such as a cell phone, tablet, etc. The consumer may experience greater convenience with being able to both charge an electronic device and operate the attachable fan device 12 with the control unit 13.

Referring now to FIGS. 21, 22, 25, 26, 27, and 29 which illustrate an embodiment of components of the electrical wiring system of the parasol fan structure/assembly 100. The electrical wiring system comprises electrical wiring 16 and electrical connectors 40. According to the example illustrated, electrical wiring 16 enters pole portion 3*a* and runs upward to connect electrically, and operably, to control circuitry 75 of the control unit 13. Electrical wiring 16 electrically connected to the control circuitry 75 then runs upward inside pole portion 3*b* and electrically connects to electrical connector 57 of the upper hub's PCB 53. Internal wiring 82 of PCB 53 electrically connects each electrical connector 56 to electrical connector 57. Electrical wiring 16 electrically connected to electrical connectors 56 and then exits the upper hub 5 via opening 54 and runs inside each rib 7 which is connected to strut portion 6*a*. Electrical wiring 16 exits rib 7, via opening 66, and runs inside strut portion 6*a* and electrically, and operably, connects to the attachable fan device motor 20. In some embodiments of the present disclosure, the electrical wiring system comprise additional electrical connectors 40. For example, the electrical wiring 16 which enters pole portion 3*a* may electrically connects with another electrical wiring 16 enroute to the control circuitry 75. Such electrical connection may be accessible through opening 43 thus allowing easy repairs when needed. Another example is the electrical connection between the electrical wiring 16 which exits the rib 7 via opening 66 and the electrical wiring 16 which run inside strut portion 6*a*, his case too exemplifies having an electrical connection at a relatively accessible location which allows for an easy repair when necessary. In some embodiments according to which the parasol fan assembly 100 comprises a plurality of switches 33 and each switch 33 is operably connected to one attachable fan device 12, electrical wiring 16 from the control unit 13 comprises a plurality of electrical wires, each electrical wire electrically and operably connected to one switch 33. According to this embodiment, electrical connector 57 comprises a plurality of distinct electrical connectors 40 to match the number of the said electrical wires. In turn, each electrical connector 56 is electrically connected to one of the distinct electrical connectors 40 comprised in electrical connector 57 via internal wiring 82. Electrical wiring 16 running from each electrical connector 56 is operably connected to one attachable fan device 12. This allows a user to operably control a chosen attachable fan device 12. In this embodiment, wherein each switch 33 is operably connected to one attachable fan device 12, the attachable fan device 12 operably connected to a switch 33 is generally positioned above that switch 33. In some other embodiments, one switch 33 is operably connected to a plurality of attachable of fan devices 12 and electrical wiring 16 from the control unit 13 comprises a number of electrical wires which matches the number of switches 33. A person skilled in the art will appreciate that variable electrical wiring is within the scope of the present disclosure.

Figure 23:
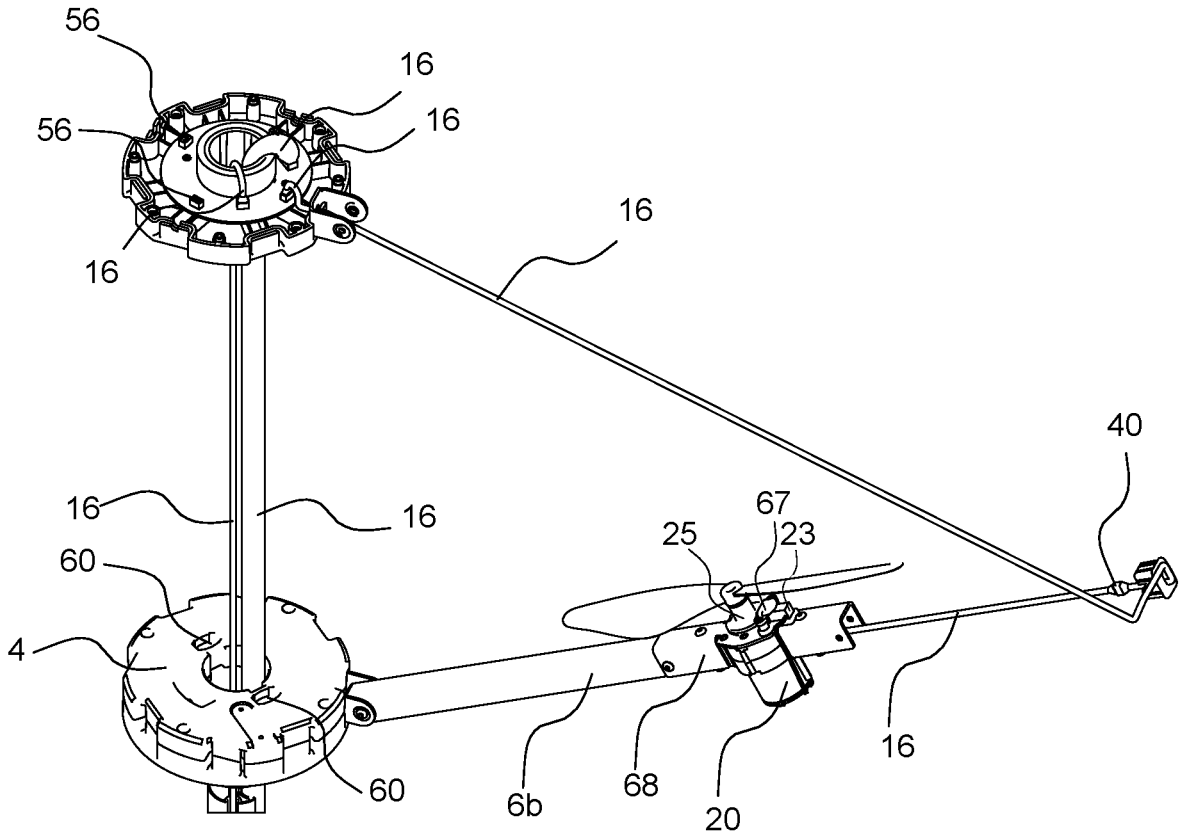
FIG. 23 is a cut away view illustrating electrical wiring between the upper hub, rib, strut, and the presently disclosed attachable fan device.
Figure 24:
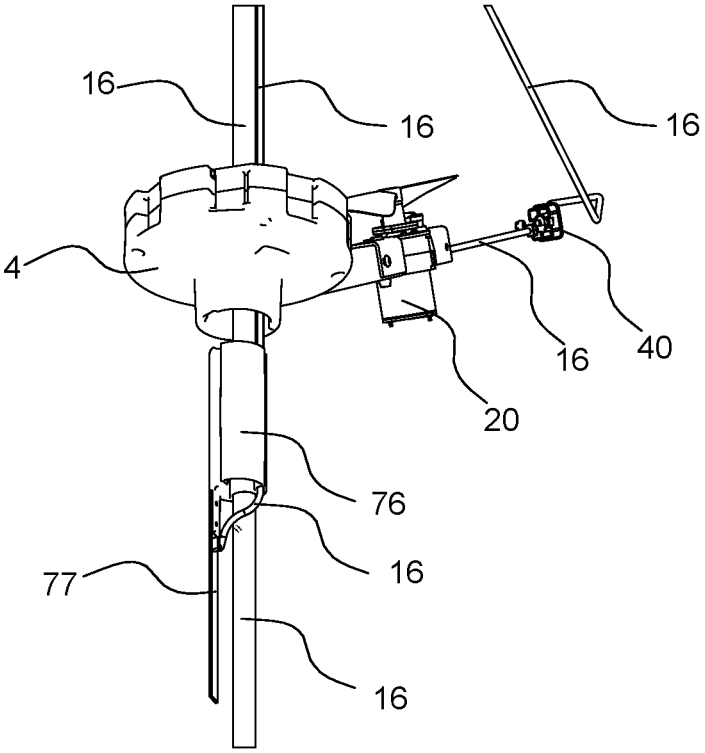
FIG. 24 is a cut away view illustrating a Hall sensor, and electrical wiring of the Hall sensor.
Figure 25:
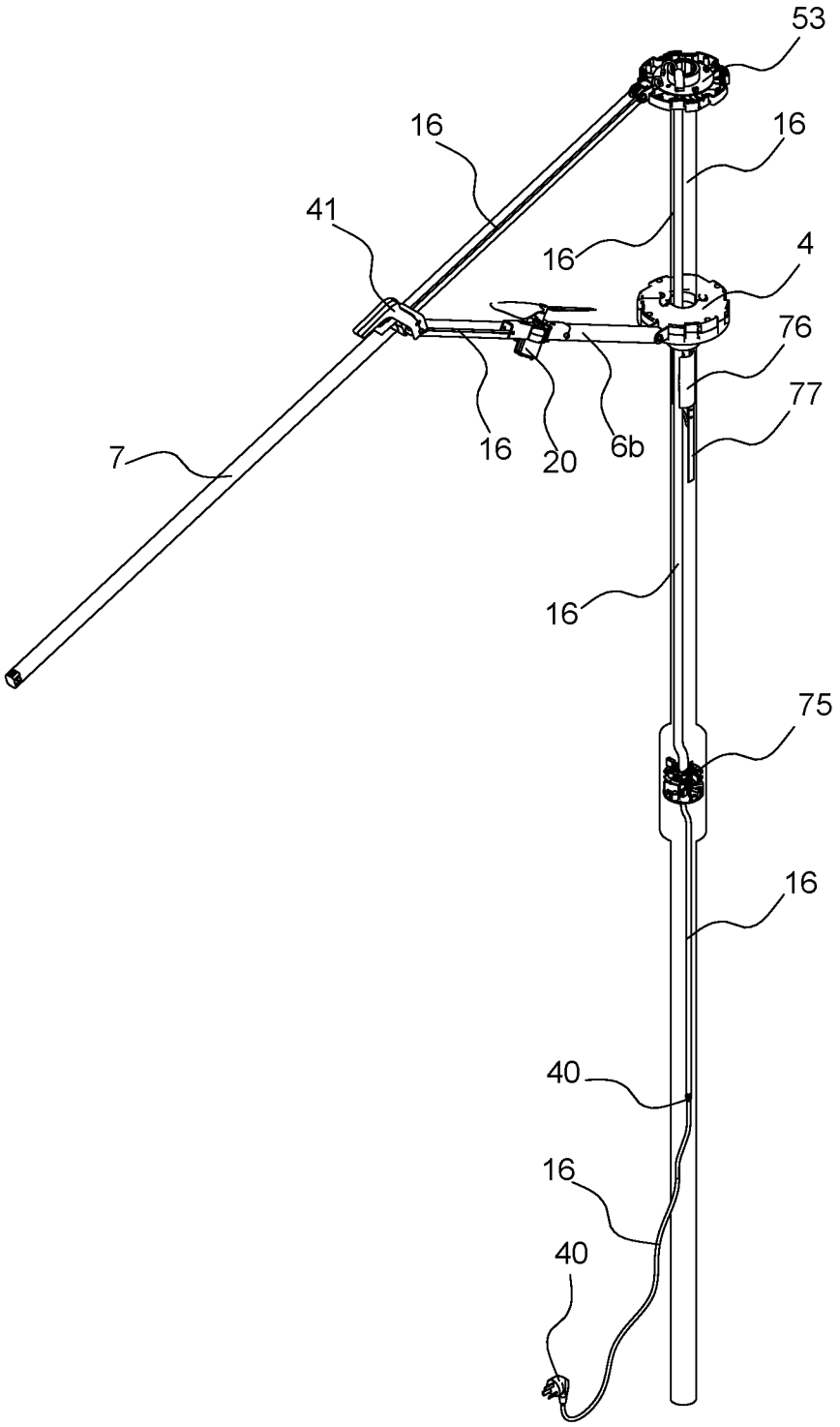
FIG. 25 is a cut away view illustrating the electrical wiring of the presently disclosed parasol fan structure, the structure comprising a Hall sensor.
Figure 26:
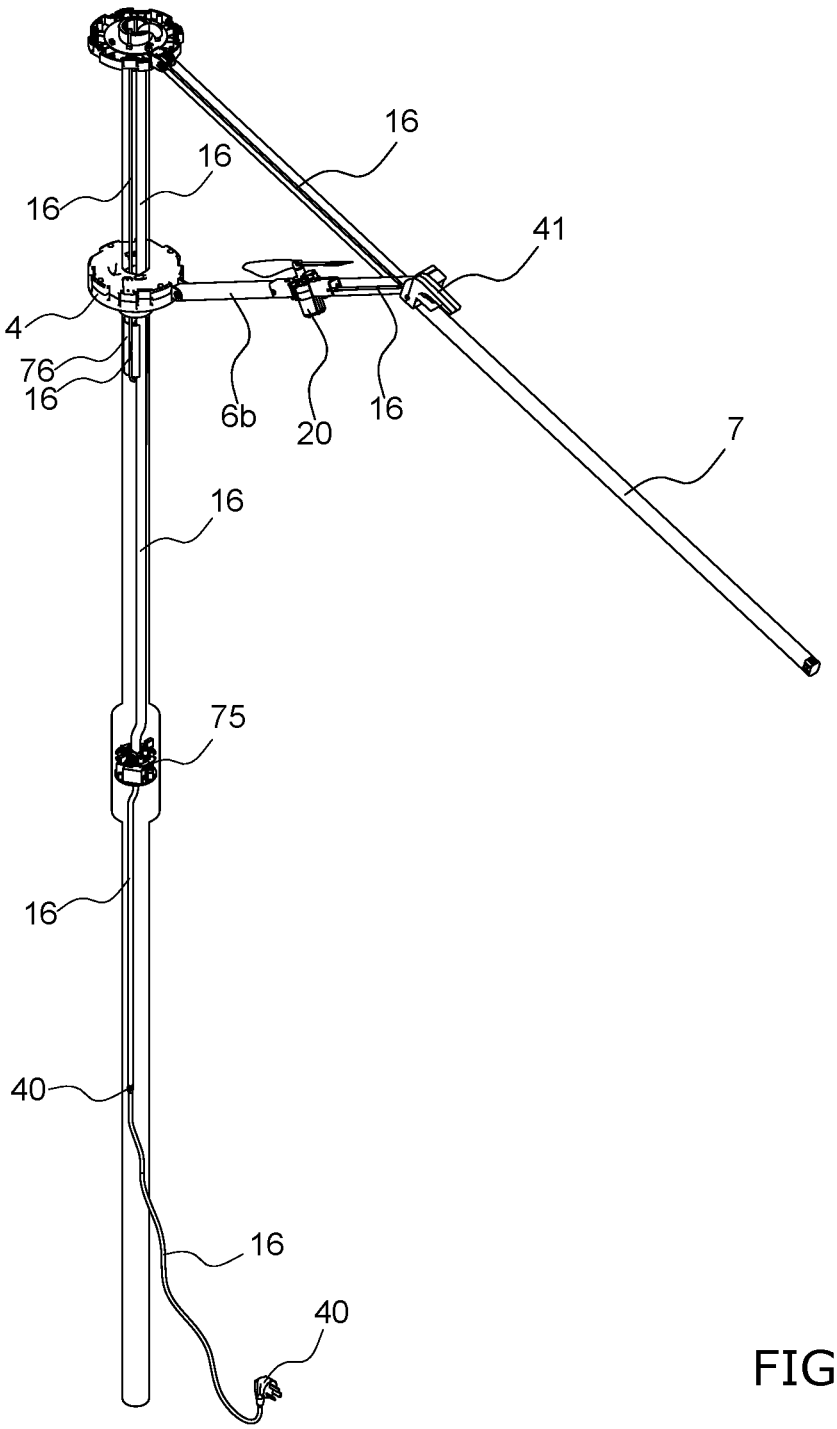
FIG. 26 is another cut away view illustrating the electrical wiring of the presently disclosed parasol fan structure, the structure comprising a Hall sensor.
Figure 27:
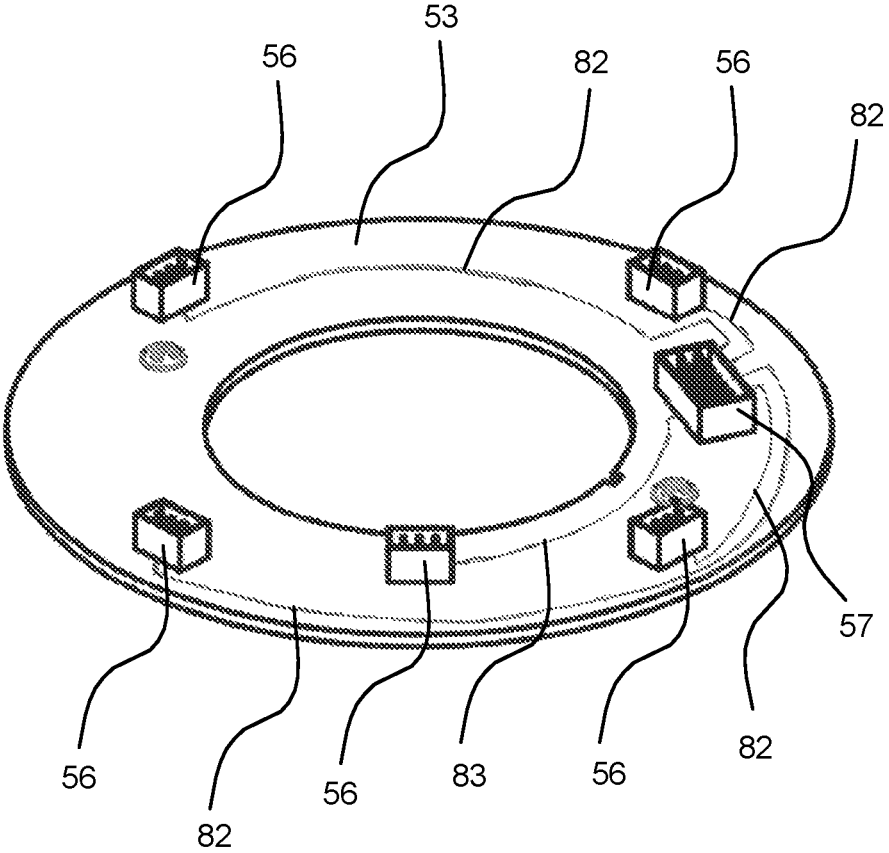
FIG. 27 is a perspective view depicting the electrical wiring of the upper hub's PCB.
Figure 29:
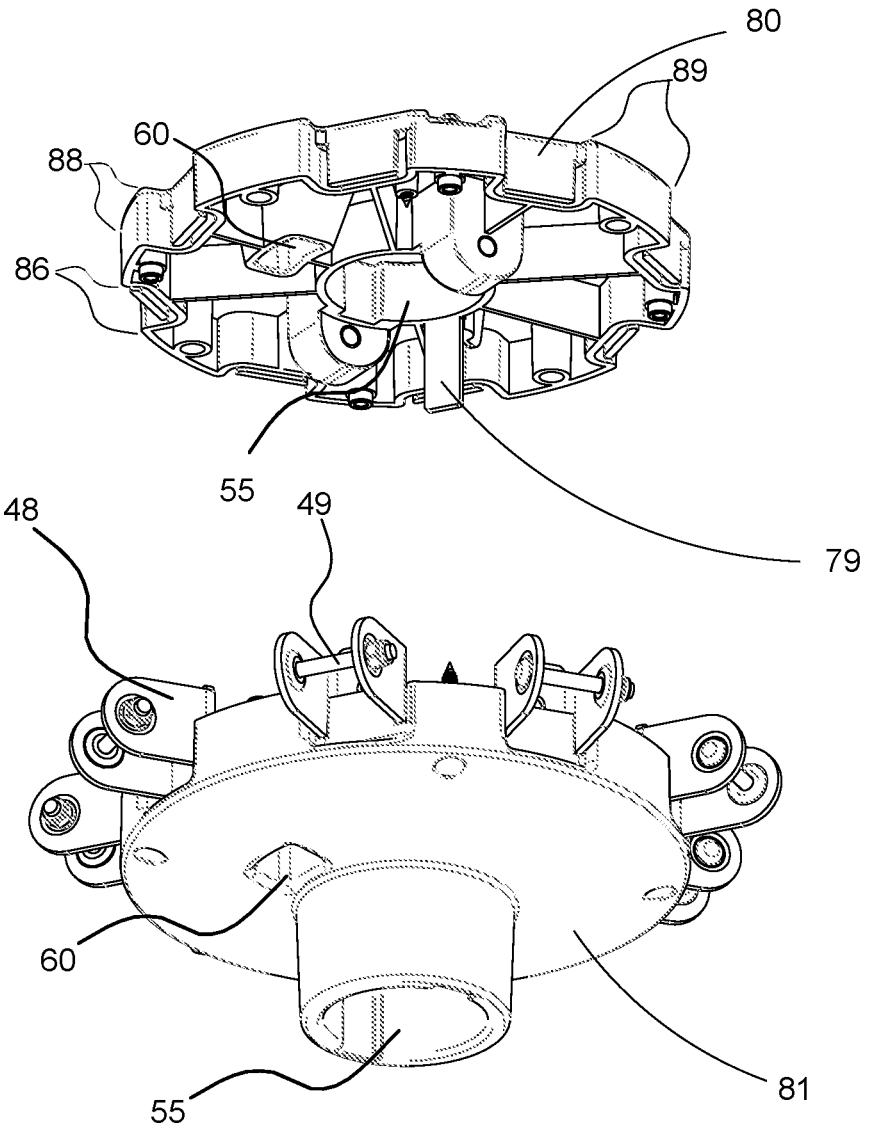
FIG. 29 is an exploded view illustrating the lower hub, the lower hub comprising a magnet.

Referring now also to FIGS. 23, 24, and 29, in some embodiments the presently disclosed electrical wiring system comprise a safety mechanism to prevent a user from accidently closing the parasol fan structure assembly 99, 100 when the attachable fan device 12 is still operating. The presently disclosed safety mechanism comprises a Hall sensor 77, a Hall sensor mounting 78, and a magnet 79. In the example illustrated herein, the Hall sensor 77 is positioned inside pole portion 3*b* and held in place by the Hall sensor mounting 78. The Hall sensor mounting 78 may be attached to the inside of pole portion 3*b* using any applicable method which will prevent its movement (during use, transport, etc.). Such methods include, but are not limited to, use of any suitable securing means, direct fixture (for example, soldering), adhesive, clips, etc. Electrical wiring 16 is electrically connecting between the Hall sensor 77 and electrical connector 58 on PCB 53. As depicted, the Hall sensor mounting 78 also serves to partially encase the electrical wiring 16 from the Hall sensor 77 as it runs upwards inside pole portion 3*b*. Internal wiring 83 of PCB 53 electrically connects electrical connector 58 to electrical connector 57, thus electrically powering the Hall sensor 77 when electrical connector 58 is powered by the control circuitry 75 of the control unit 13. As depicted in FIG. 29 the lower hub 4 comprises a magnet 79. In some embodiments, the magnet is positioned inside the lower hub 4 and close to its internal circumference (i.e., proximal to pole portion 3*b*). Depicted in FIG. 29 are a top cover 80 of the lower hub and a bottom cover 81 of the lower hub, both comprising opening 60 for the passage of rope 11. In some embodiments, the lower hub 4 of the presently disclosed parasol fan assembly 100 is bigger than what is traditionally used in the art. This allows for more space between the center pole 3*a*, 3*b*, and the strut 6*a*, 6*b* which comprises the attachable fan device. The dimension of the Lower hub 4 of the present disclosure allowed the creation of opening 60. Rope 11 passing through opening 60 instead of to the side of it allow a user to pull or release the rope 11 vertically, thus avoiding the rope 11 getting caught, or entangled, on a moving blade 17, or otherwise any of the attachable fan device/s 12 parts. When the Hall sensor 77 is electrically powered and proximal to the magnet 79, it allows electrical connector 57 to electrically power electrical connectors 56, and in turn power the attachable fan devices 12. When the Hall sensor 77 is not proximal to the magnet 79, it will turn off electrical power to electrical connector 57, and not allow, or cease, the operation of the attachable fan devices 12. Hall sensor 77 is generally positioned inside pole portion 3*b* such that it overlaps with the lower hub 4 position when the parasol fan structure/assembly 99, 100 is in a pre-determined open configuration/s, generally allowing the operation of the attachable fan device/s 12 only in these pre-determined open configuration/s. This prevents an accidental operation of the attachable fan device/s 12 when the parasol fan structure/assembly 99, 100 is in a closed, or partially closed configuration, thus preventing damage to the attachable fan device/s 12 or any other part/s of the parasol fan structure/assembly 99, 100.

In some embodiments, the Hall sensor 77 shuts of the electrical circuitry of electrical connector 57 when magnet 79 and the Hall sensor 77 do not overlap. In some other embodiments, Hall sensor 77 shuts of the electrical circuitry of electrical connector 57 when magnet 79 and the Hall sensor 77 have a certain distance between them. In some embodiments, the distance is in a range of about 0.5-30 centimeters. According to some other embodiments, the distance is in a range of about 1-15 centimeters. In some other embodiments, the distance is in a range of 3-10 centimeters. In yet some other embodiments, the distance is about 3, 4, 5, 6, 7, 8, 9, or 10 centimeters.

Figure 30:
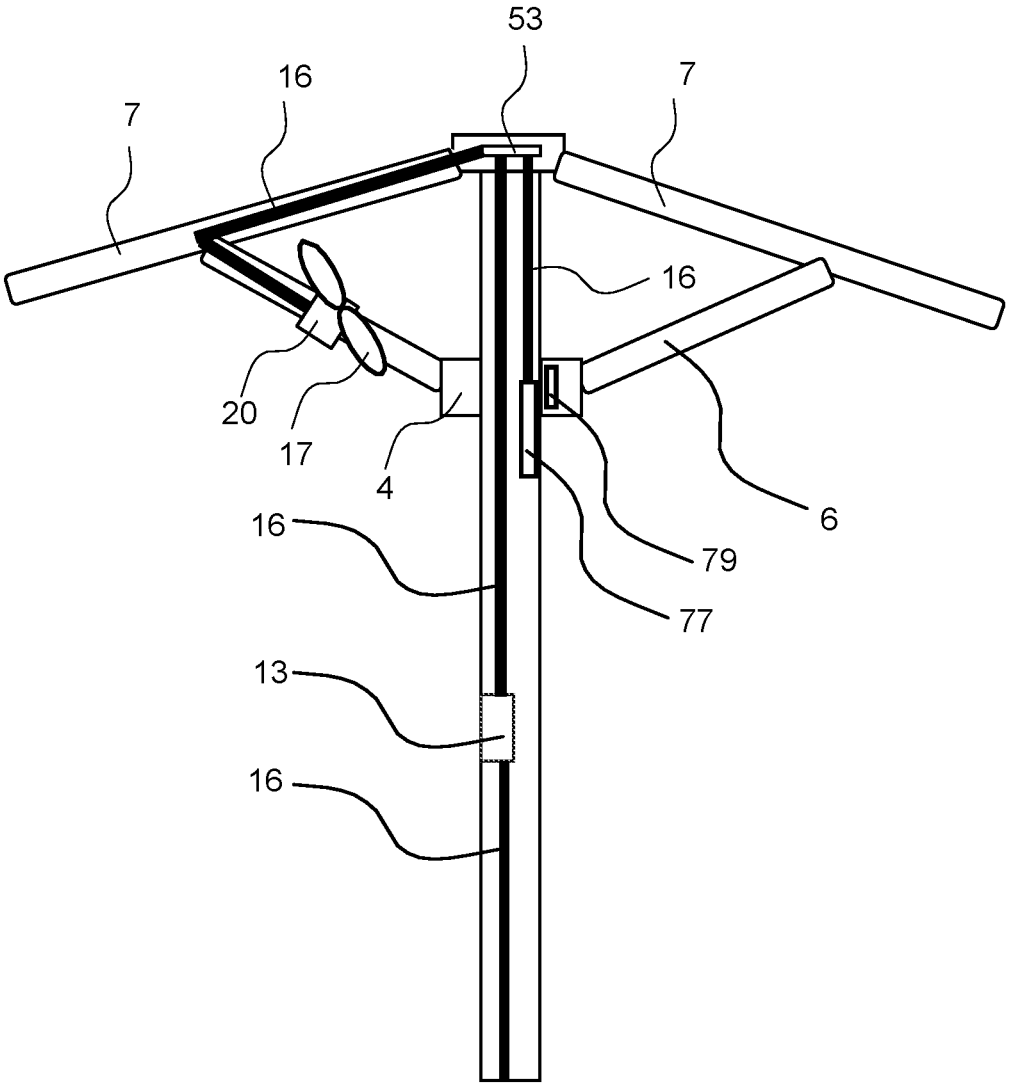
FIG. 30 is a sectional view schematic illustrating the presently disclosed parasol fan assembly in a first open configuration.
Figure 31:
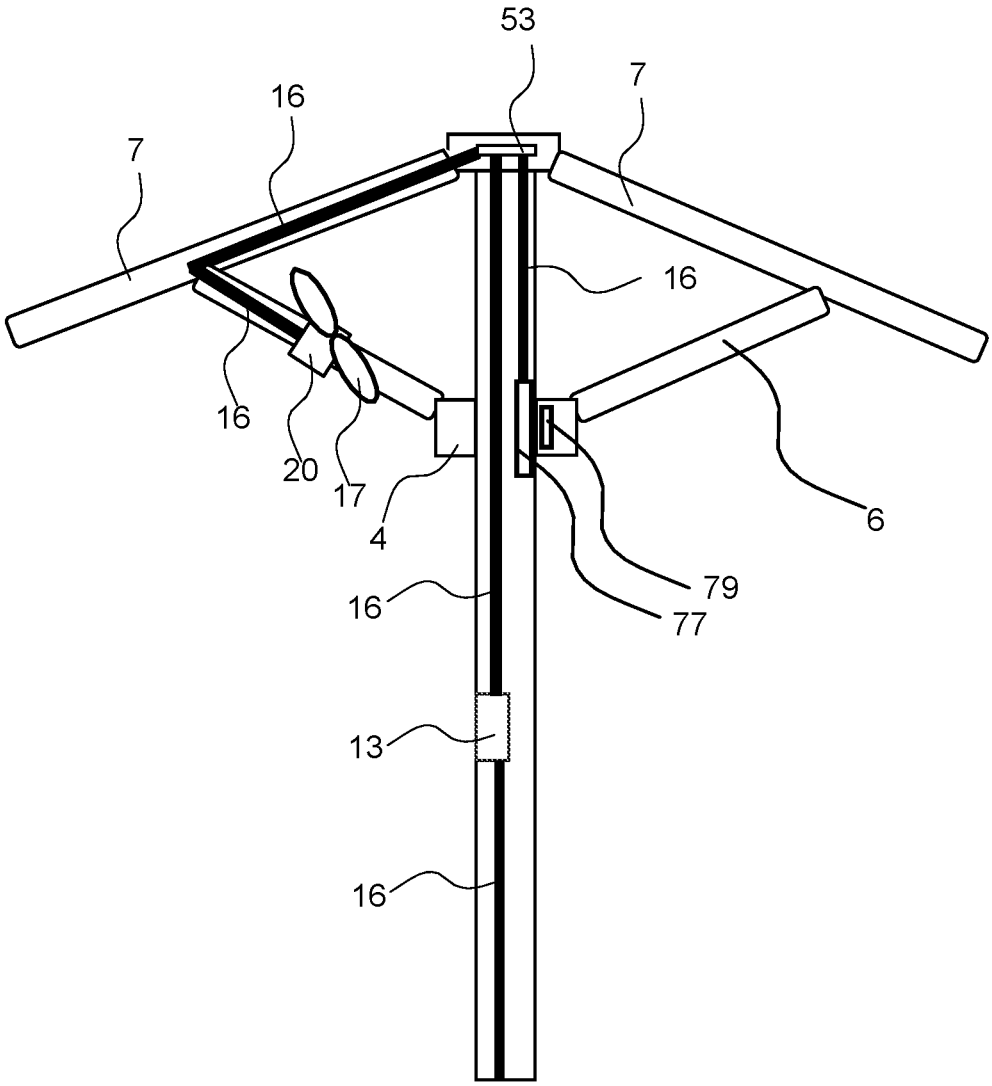
FIG. 31 is a sectional view schematic illustrating the presently disclosed parasol fan assembly in a second open configuration.
Figure 32:
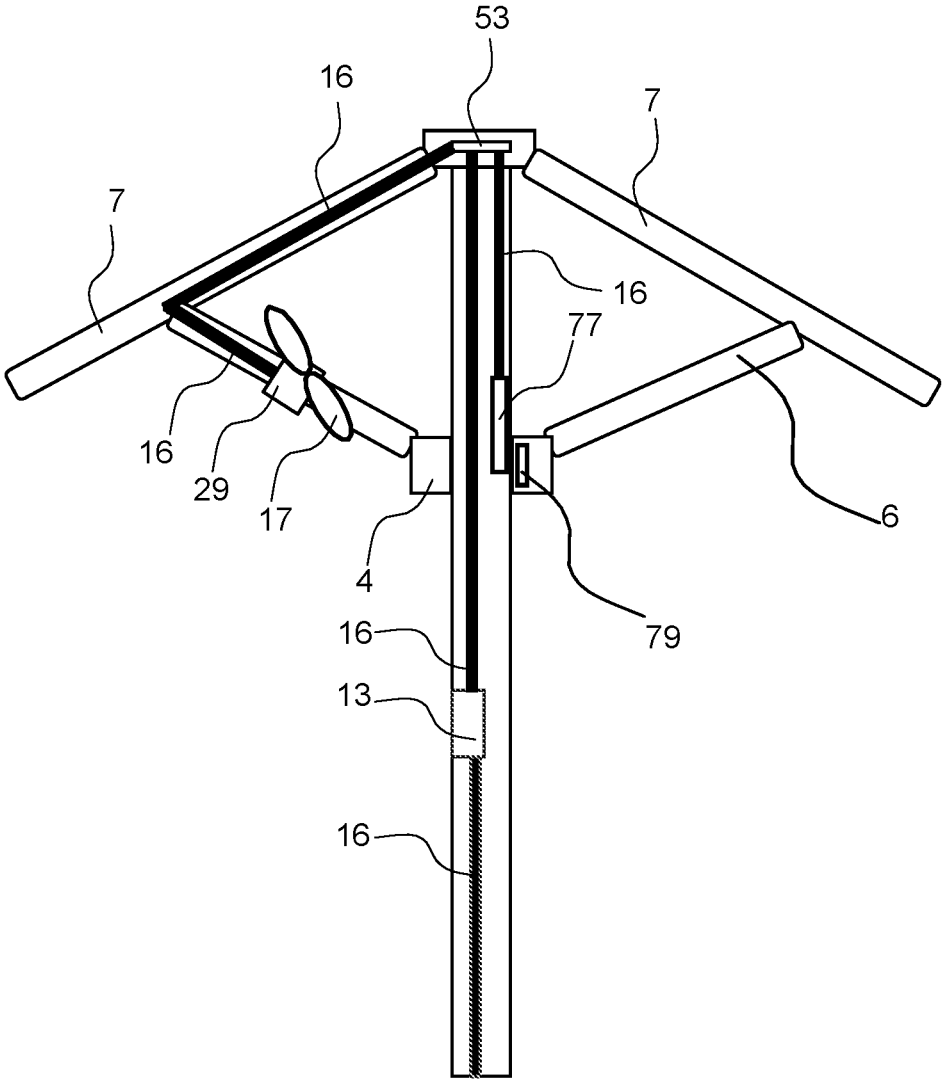
FIG. 32 is a sectional view schematic illustrating the presently disclosed parasol fan assembly in a third open configuration.
Figure 33:
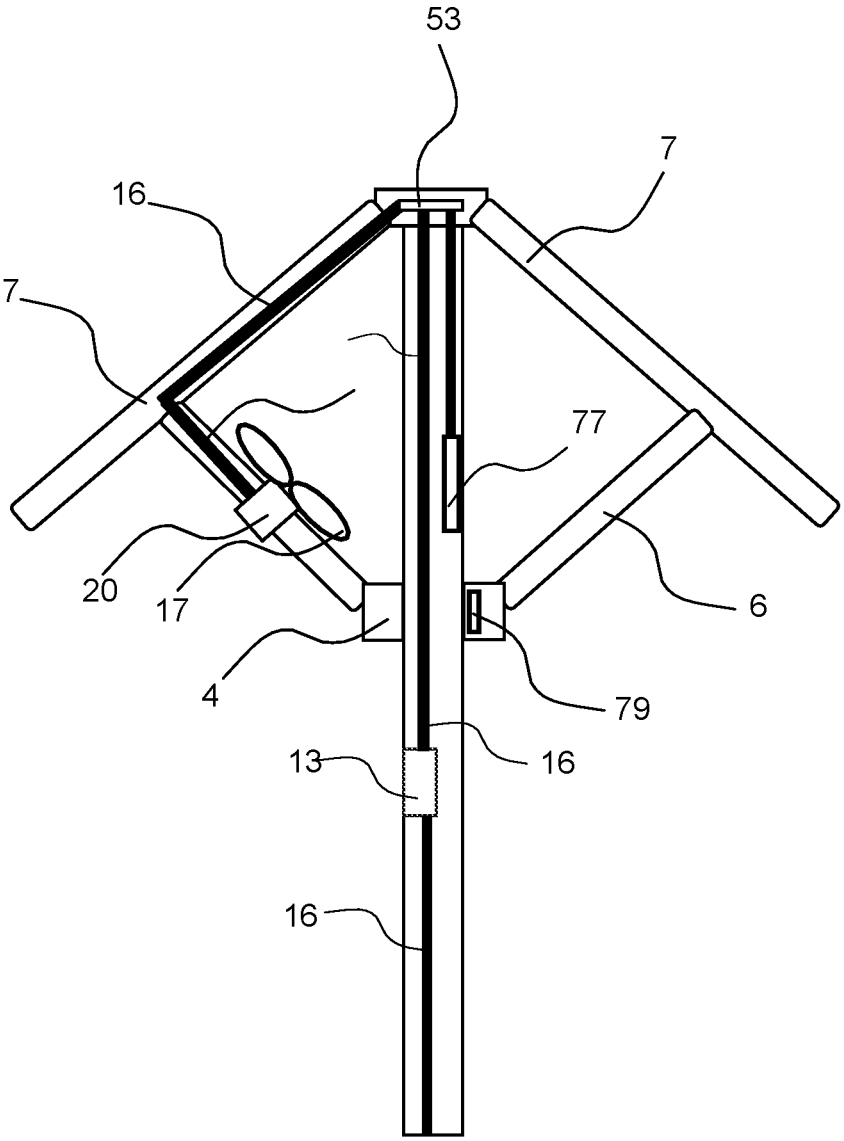
FIG. 33 is a sectional view schematic illustrating the presently disclosed parasol fan assembly in a partially closed configuration.

FIGS. 30-33 schematically depict the electrical wiring system including the position of the magnet 79 relative to Hall sensor 77 when the parasol fan structure/assembly 99, 100 is in an open, or partially closed, configuration. FIG. 30 depicts the parasol fan structure/assembly 99, 100 in a first pre-determined open configuration according to which the lower hub 4 is secured in the highest pre-determined position along pole portion 3*b*. In the first pre-determined open configuration exemplified, the magnet 79 partially overlaps with Hall sensor 77, and Hall sensor 77 allows the operation of the attachable fan device 12. FIG. 31 depicts the parasol fan structure/assembly 99, 100 in a second pre-determined open configuration according to which the lower hub 4 is secured in a middle pre-determined position along pole portion 3*b*. In the second pre-determined open configuration exemplified, the magnet 79 fully overlaps with Hall sensor 77, and Hall sensor 77 allows the operation of the attachable fan device 12. FIG. 32 depicts the parasol fan structure/assembly 99, 100 in a third pre-determined open configuration according to which the lower hub 4 is secured in the lowest pre-determined position along pole portion 3*b*. In the third pre-determined open configuration exemplified, the magnet 79 again partially overlaps with Hall sensor 77, and Hall sensor 77 allows the operation of the attachable fan device 12. Finally, FIG. 33 depicts the parasol fan structure/assembly 99, 100 in a partially closed configuration. This will happen, for example, when a user starts to close the parasol fan assembly 100, sliding the lower hub 4 downwards along pole portion 3*b*, perhaps forgetting to shut off the operation of the attachable fan device 12. In the partially closed configuration exemplified, the magnet 79 no longer overlaps with Hall sensor 77, and the distance between the magnet 79 and Hall sensor 77 is such that the Hall sensor 77 shuts off the circuitry and ceases the operation of the attachable fan device 12. As the operation of the attachable fan device 12 ceases the blades 17 come to a stop in a position parallel to strut portions 6*a* and 6*b*.

Figure 34:
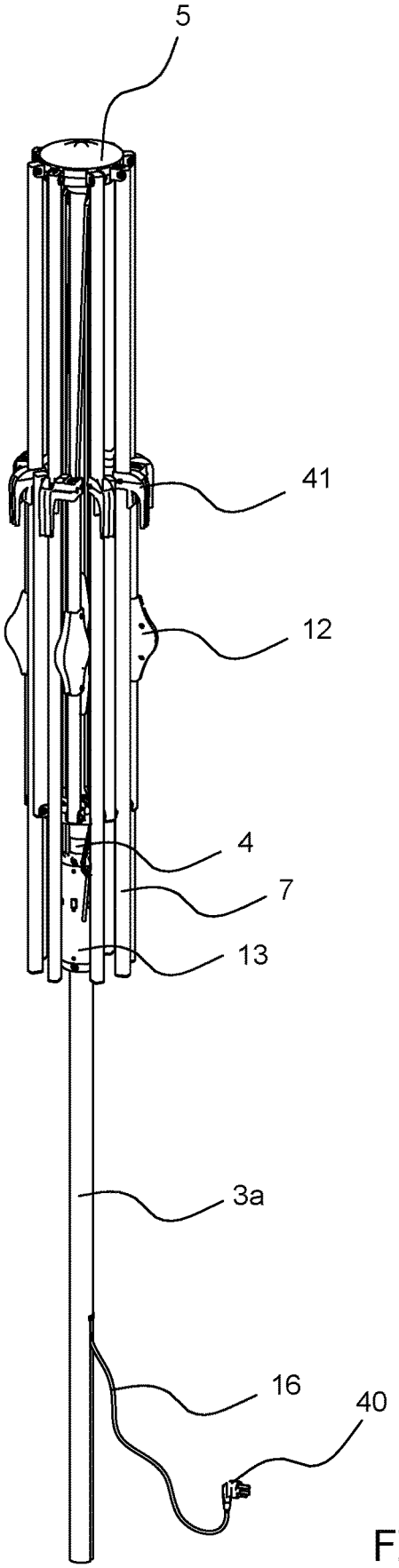
FIG. 34 shows a perspective view illustration of a parasol fan structure, the structure in a closed configuration.

Finally, referring to FIG. 34, the presently disclosed parasol fan structure 99 is depicted in a closed configuration and the lower hub 4 is in a position proximal control unit 13. Ribs 7 are substantially parallel to pole portions 3*a*, 3*b*, and the fan blades 17 are parallel to struts 6*a*, 6*b* and therefore are not damaged in the closed configuration, and do not damage any of the parasol fan structure/assembly 99, 100 parts.

In some embodiments, the presently disclosed parasol fan structure/assembly 99, 100 may include wired power delivery and wired control, wired power delivery and wireless control, a local power source in use with the attachable fan device 12 and wireless control that is integral with the control unit 13, or a local power source in use with the attachable fan device 12 and wireless control that is distinct from the control unit 13.

Both delivery of power and control of the attachable fan device 12 may be provided through electrical wiring 16, as shown herein. In this embodiment, electrical wiring 16 connects an AC source to the control unit 13 and also connects the control unit 13 to the attachable fan device 12 for delivery of power to the attachable fan device 12. The control unit 13 may be operated by pressing buttons or operating dials or switches thereon, which in tum modulates control circuitry 31 to control the attachable fan device 12. In some embodiments, the control circuitry 31 may be structurally associated with or otherwise integral with the control unit 13 and may be operably connected to buttons or switches of the control unit 13 for operation. In this manner, the user may operate the attachable fan device 12 with the control unit 13.

In embodiments wherein power is delivered to the attachable fan device via electrical wiring 16 from the control unit 13, control of the fan device 12 may be achieved with a wireless connection (not shown). In various embodiments and possibly independent of how power is delivered to the attachable fan device 12, the control circuitry 31 may be structurally associated with or integral with the control unit 13, or, alternatively, may be structurally separate from, separable, or distinct from the control unit 13.

In embodiments with a wireless connection configured for control of the attachable fan device 12, the control unit 13 may be configured to constantly deliver power to the attachable fan device 12 and control of the use of the power to operate the attachable fan device 12 may be determined with a local control circuit of the attachable fan device 12 that may be operably connected to a wireless receiver that is configured to receive control signals from a wireless transmitter that is operably connected to the control circuitry 31, whether the control circuitry 75 is integral with the control unit 13 or is separate from the control unit 13.

In any embodiment in which there is a wireless connection, control signals may be sent and received over the wireless connection using any suitable wireless communication protocol, including but not limited to Bluetooth®, WiFi, infrared transmission, etc. When a start signal is received to initiate the attachable fan device 12 to tum on and begin operating, the local control circuit of the attachable fan device 12 may close to cause power to be delivered to the motor and the electric actuator of the attachable fan device 12. When a stop signal is received to initiate the attachable fan device to tum off and stop operating, the local control circuit of the attachable fan device 12 may open to cause power to no longer be delivered to the motor and the electric actuator of the attachable fan device 12, which causes the fan blades 17 to stop rotating and become aligned with the strut 6*a*, 6*b* of the parasol, as disclosed herein.

In at least some embodiments, the electrical wiring 16 may be used to deliver power from an AC source to the control unit 13, which may drive control circuitry 75 and may be a charge source for recharging a local power source of the attachable fan device 12. The local power source may be a battery or a plurality of batteries, such as rechargeable batteries, e.g., rechargeable lithium-ion batteries. In instances wherein a rechargeable battery is used, the control unit 13 may include ports (e.g., dedicated, or multi-purpose ports) configured for recharging the rechargeable batteries when not in use. Similarly, if a wireless controller incorporates control circuitry, the wireless controller may need to be recharged, and the control unit 13 may include ports (e.g., dedicated, or multi-purpose ports) for this purpose.

The foregoing descriptions of specific implementations have been presented for purposes of illustration and description. They are not intended to be exhaustive or to limit the invention to the precise forms disclosed, and modifications and variations are possible in view of the above teaching. The exemplary implementations were chosen and described to best explain the principles of the invention and its practical application, to thereby enable others skilled in the art to best utilize the invention and its implementations with modifications as suited to the use contemplated.

It is therefore submitted that the invention has been shown and described in the most practical and exemplary implementations. It should be recognized that departures may be made which fall within the scope of the invention. With respect to the description provided herein, it is submitted that the optimal features of the invention include variations in size, materials, shape, form, function, manner of operation, assembly, and use. All structures, functions, and relationships equivalent or essentially equivalent to those disclosed are intended to be encompassed by the invention.

Any discussion of documents or subject matter included in the present disclosure is not to be taken as an admission that any, or all, of these materials form part of the prior art base or were common general knowledge in the field relevant to the present disclosure as it existed before the priority date of each claim of this and any continuing application.

I claim:

1. An attachable fan device, the attachable fan device comprises:

a fan component housing, wherein the fan component housing partially encases an electric motor comprising a shaft which rotates when the electric motor is powered by electricity, an electric actuator electrically connected to the electric motor and operably connected to a biased pin, and a notched disk wherein the notched disk comprises at least one pair of opposing notches thereon, with each notch designed to receive the biased pin, and a tubular shaft operably connected to the shaft of the electric motor;

a fan component, wherein the fan component comprises at least two fan blades and a center hub therebetween, the center hub operably attached to the tubular shaft such that the fan blades are substantially parallel to the notches of the notched disk; and two opposing parasol attachments configured to attach the fan component housing to a strut of a parasol, wherein the parasol attachments are tubular and have a first end and a second end, wherein the first end of each parasol attachment is attached to the fan component housing, and wherein the parasol attachments are substantially parallel to the biased pin;

wherein when the electric motor is powered by electricity, the electric actuator actuates to retract the biased pin from a protruded position in which the biased pin is inserted in one of notches of the notched disk to retracted position in which the biased pin is outside the notches of the notched disk, thus allowing the notched disk to rotate and in turn rotate the fan blades;

and, wherein when the electric motor is not powered by electricity, the electric actuator releases the biased pin from the retracted position allowing the biased pin to enter one of the notches of the notched disk, thus preventing the notched disk and fan blades from rotating, and wherein when the fan blades' rotation ceases, the fan blades are positioned substantially parallel to the notches of the notched disk.

2. The attachable fan device of claim 1, wherein a power source for the attachable fan device is selected from a group comprising: electricity via electrical wiring, battery, or a plurality of batteries.

3. A parasol fan assembly, comprising:

a parasol comprising a plurality of ribs, a canopy, a plurality of struts, a pole, and a lower hub engaged to the pole, wherein each rib of the plurality of ribs comprises a first end and a second end, wherein the second end is coupled to the canopy, and the first end is attached to the pole, and wherein each strut of the plurality of struts connects between a rib of the plurality of ribs and the lower hub;

at least one attachable fan device attached to at least one strut of the plurality of struts, wherein the said at least one strut comprises two opposing strut portions, a first strut portion attached to the rib, and a second strut portion attached to the lower hub, the two opposing strut portions attached to the attachable fan device therebetween, wherein the attachable fan device comprises (i) a fan component housing, wherein the fan component housing partially encases an electric motor comprising a shaft which rotates when the electric motor is powered by electricity, an electric actuator electrically connected to the electric motor and operably connected to a biased pin, and a notched disk wherein the notched disk comprises at least one pair of opposing notches thereon, with each notch configured to receive the biased pin, and a tubular shaft operably connected to the shaft of the electric motor; (ii) a fan component, wherein the fan component comprises at least two fan blades and a center hub therebetween, the center hub operably attached to the tubular shaft such that the fan blades are substantially parallel to the notches of the notched disk; and (iii) two opposing parasol attachments configured to attach the fan component housing to the said at least one strut of the parasol, wherein the parasol attachments are tubular and have a first end and a second end, wherein the first end of each parasol attachment is attached to the fan component housing, and wherein the parasol attachments are substantially parallel to the biased pin; and a power source for the attachable fan device is selected from a group comprising: electricity via electrical wiring, battery, or a plurality of batteries;

wherein when the electric motor is powered by electricity, the electric actuator actuates to retract the biased pin from a protruded position in which the biased pin is inserted in one of notches of the notched disk to retracted position in which the biased pin is outside the notches of the notched disk, thus allowing the notched disk to rotate and in turn rotate the fan blades; and, wherein when the electric motor is not powered by electricity, the electric actuator releases the biased pin from the retracted position allowing the biased pin to enter one of the notches of the notched disk, thus preventing the notched disk and fan blades from rotating, and wherein when the fan blades' rotation ceases, the fan blades are positioned substantially parallel to the notches of the notched disk.

4. The parasol fan assembly of claim 3, wherein the pole is a center pole and further comprises an upper hub, wherein the plurality of ribs are pivotally attached to the upper hub, and the end of the center pole opposite to the upper hub is reversibly attached to a base; wherein the attachment of each strut of the plurality of struts to the lower hub is a pivotal attachment; wherein the attachment of each strut of the plurality of struts to a rib of the plurality of ribs is a pivotal attachment; wherein the lower hub is slidable along the center pole, and wherein when the lower hub slides up the pole each strut, and rib pivotally attached to it, rotates outward with respect to the center pole, thus raising the canopy and positioning the parasol fan in an open configuration; and, wherein when the lower hub slides down the center pole each strut, and rib pivotally attached to it, rotates inward with respect to the center pole, thus lowering the canopy and positioning the parasol fan in a closed configuration.

5. The parasol fan assembly of claim 4, wherein the lower hub can be reversibly secured to the center pole in a plurality of pre-determined open configurations.

6. The parasol fan assembly of claim 5, wherein the center pole, the ribs pivotally attached to the struts which comprise the attachable fan device, and the struts which comprise the attachable fan device are tubes.

7. The parasol fan assembly of claim 6, wherein the power source for the attachable fan device is electricity delivered via electrical wiring.

8. The parasol fan assembly of claim 7, further comprising a control unit operably connected to the attachable fan device, wherein the control unit comprises: control circuitry operably connected to an at least one switch, the at least one switch is controllable by a user; wherein an operation of a switch of the at least one switch corresponds to the operation of an electric motor of one of the at least one attachable fan device.

9. The parasol fan assembly of claim 8, wherein the electrical wiring runs upward inside the center pole and is electrically connected to the control unit, electrically powering the control unit, wherein from the control unit the electrical wiring runs upward inside the center pole toward the upper hub, from inside the upper hub the electrical wiring runs inside the at least one rib which is pivotally attached to the at least one strut comprising the attachable fan device, from the said at least one rib the wire runs inside the said at least one strut and on to electrically connect to the motor of the attachable fan device, and thus coupling the control unit to the operation of the electrical motor of the attachable fan device; and, wherein the electrical wiring entering the pole comprises an end positioned outside the pole, said end electrically connectable to a source of alternating current.

10. The parasol fan assembly of claim 9, wherein the upper hub comprises an upper PCB (Printed Circuit Board); wherein the electrical wiring from the control unit is electrically connected to the upper PCB; wherein electrical wiring which runs inside the at least one rib pivotally attached to the at least one strut comprising the attachable fan device is electrically connected to the upper PCB; and, wherein electrical wiring within the upper PCB electrically connects each of the said electrical wiring from the at least one rib to an electrical power provided by the electrical wiring from the control unit.

11. The parasol fan assembly of claim 10, wherein the at least one attachable fan device comprises two or more attachable fan devices; wherein the control unit comprises a designated switch for each of the attachable fan devices; wherein the electrical wiring from the control unit comprises an electrical wire operably connected to each switch; wherein electrical wiring from each rib of the plurality of ribs which is pivotally attached to the at least one strut comprising the attachable fan device is electrically and operably connected to a specific switch on the control unit, and, thus, allowing a user to separately control the operation of each one of the attachable fan devices.

12. The parasol fan assembly of claim 11, further comprising a Hall sensor, the Hall sensor positioned inside the center pole; wherein the position of the Hall sensor overlaps with the position of the lower hub when the parasol fan is configured in one of the open configurations of the plurality of pre-determined open configurations; wherein the lower hub comprises a magnet; wherein electrical wiring electrically connects the Hall sensor to the upper PCB; wherein electrical wiring inside the upper PCB electrically connects the Hall sensor wiring to the electrical wiring from the control unit, thus operably connecting the Hall sensor to the operation of the control unit.

13. The parasol fan assembly of claim 12, wherein when the parasol fan is in one of the open configurations of the plurality of pre-determined open configurations, and the at least one switch is switched on, the proximity of the magnet to the Hall sensor allows the operation of the at least one attachable fan device; and, wherein when the lower hub is moved from an open configuration of the plurality of pre-determined open configurations downward along the center pole, the distance between the magnet and the Hall sensor increases and the Hall sensor switches off the electrical circuitry of the upper PCB and control unit; and, thus, the at least one attachable device can be operated, or the operation of the at least one attachable device can continue, only when the parasol fan is an open configuration.

14. The parasol fan assembly of claim 13, wherein the parasol fan comprises eight ribs, four struts which comprise an attachable fan device each, and four struts which do not comprise an attachable fan device; wherein a first four ribs of the eight ribs each pivotally attach to a strut which comprise an attachable fan device; wherein a second four ribs of the eight ribs each pivotally attach to a strut which does not comprise an attachable fan device; and, wherein the first four ribs and the second four ribs are arranged in an alternate pattern such that a rib pivotally attached to a strut comprising an attachable fan device is positioned in between two ribs pivotally attached to struts which do not comprise an attachable fan device.

15. The parasol fan assembly of claim 14, wherein the control unit further comprises: a charge port configured to charge an electronic device of the user.

16. The parasol fan assembly of claim 15, wherein the attachable fan device further comprises two parasol attachment inserts, the parasol attachment inserts substantially tubular and comprising a first end and a second end; wherein a first end of each parasol attachment insert is attached to the second end of each parasol attachment.

17. The parasol fan assembly of claim 16, wherein the attachment of the said strut portions to the attachable fan device is via the second ends of the parasol attachment inserts.

18. The parasol fan assembly of claim 17, wherein the canopy comprises at least one opening, and wherein the opening serves as a vent to allow air circulation for the operation of the attachable fan device.

* * * * *